US006076029A

United States Patent [19]

Watanabe et al.

[11] Patent Number: 6,076,029

[45] Date of Patent: Jun. 13, 2000

[54] SLOPE EXCAVATION CONTROLLER OF HYDRAULIC SHOVEL, TARGET SLOPE SETTING DEVICE AND SLOPE EXCAVATION FORMING METHOD

[75] Inventors: Hiroshi Watanabe, Ushiku; Kazuo Fujishima; Masakazu Haga, both of Ibaraki-ken, all of Japan

[73] Assignee: Hitachi Construction Machinery Co., Ltd., Tokyo, Japan

[21] Appl. No.: 09/155,887

[22] PCT Filed: Feb. 12, 1998

[86] PCT No.: PCT/JP98/00559

§ 371 Date: Oct. 8, 1998

§ 102(e) Date: Oct. 8, 1998

[87] PCT Pub. No.: WO95/30059

PCT Pub. Date: Sep. 11, 1995

[30] Foreign Application Priority Data

Feb. 13, 1997 [JP] Japan ..... 9-29037

[51] Int. Cl.[7] ..... E02F 5/00; E02F 3/00; G06F 7/00

[52] U.S. Cl. ..... 701/50; 37/340; 37/382; 172/4; 172/4.5

[58] Field of Search ..... 701/50; 37/348, 37/382; 414/680; 172/4, 4.5

[56] References Cited

U.S. PATENT DOCUMENTS 4,829,418 5/1989 Nielsen et al. ..... 364/167.01

5,701,691 12/1997 Watanabe et al. ..... 701/50

FOREIGN PATENT DOCUMENTS

| | | |
|---|---|---|
| 3-295933 | 12/1991 | Japan . |
| 3-295934 | 12/1991 | Japan . |
| 5-33363 | 2/1993 | Japan . |
| 8-246492 | 9/1996 | Japan . |
| 8-246493 | 9/1996 | Japan . |
| WO95/30059 | 9/1995 | WIPO . |

*Primary Examiner*—William A. Cuchlinski, Jr.
*Assistant Examiner*—Yonel Beaulieu
*Attorney, Agent, or Firm*—Beall Law Offices

[57] ABSTRACT

A slope excavation control system for a hydraulic excavator and a slope excavation method using a hydraulic excavator include an external reference 80 which extends horizontally in the direction of advance of a target slope face. A vertical distance hry and a horizontal distance hrx from the external reference to a reference point on a target slope face, and an angle of the target slope face are set by using a setting device. When a front reference provided at a bucket end is aligned with the external reference and an external reference setting switch is depressed, a control unit calculates a vertical distance hfy and a horizontal distance hfx from a body center of the excavator to the external reference, then calculates a vertical distance hsy and a horizontal distance hsx from the body center to the reference point of the target slope face by using the distances hsy and hsx as modification values. The control unit then sets the target slope face on the basis of a body of the excavator from the distances hsy and hsx and the angle input by the setting device, thereby carrying out area limiting excavation control.

13 Claims, 18 Drawing Sheets

UNDER SETTING

UNDER MOVEMENT

SLOPE EXCAVATION CONTROLLER OF HYDRAULIC SHOVEL, TARGET SLOPE SETTING DEVICE AND SLOPE EXCAVATION FORMING METHOD

TECHNICAL FIELD

The present invention relates to a slope excavation control system for a hydraulic excavator, a target slope face setting system, and a slope excavating method using a hydraulic excavator, and more particularly to a slope excavation control system for a hydraulic excavator, a target slope face setting system, and a slope excavating method using a hydraulic excavator, with which when a front device comes close to a preset target excavation plane, area limiting excavation control is performed to make the front device move along the target excavation plane, thereby excavating the ground to establish the target excavation plane.

BACKGROUND OF ART

There is known a hydraulic excavator as a typical one of such construction machines. In a hydraulic excavator, front members such as a boom and an arm, which constitute a front device, are operated by respective manual control levers. However, because the front members are coupled to each other through articulations for pivoting motion, it is very difficult to carry out excavation work over a predetermined area, particularly an area set by linear lines, by operating the front members. For this reason, there is a demand for enabling such work to be performed in an automatic manner. Various proposals for automating such work have been made.

According to International Laid-open Publication WO95/30059, for example, an excavation enable area is set on the basis of a body as a reference, and excavation is controlled such that when part of a front device, e.g., a bucket, comes close to the boundary of the excavation enable area, only movement of the bucket toward the boundary is slowed down, and when the bucket reaches the boundary of the excavation enable area, the bucket is allowed to move along the boundary of the excavation enable area while it is kept from moving out of the excavation enable area.

When a hydraulic excavator is designed to perform the above-mentioned work in an automatic manner, the posture and height of the hydraulic excavator itself are varied due to change in topography of the work site if a body of the excavator is moved. This means that the area set with respect to the body must be set again whenever the body is moved. In view of the above, JP, A, 3-295933 proposes an automatic excavation method for overcoming that drawback. The proposed automatic excavation method comprises the steps of detecting a height of an excavator body by a sensor, which is mounted on the body, using a laser beam from a laser oscillator installed on the ground to be excavated, determining an excavation depth (corresponding to the limited area in the above related art) based on the detected height of the body, excavating the ground linearly over a predetermined length while the body is kept stopped, then traveling the body by a predetermined distance, detecting change in height of the body by using the laser beam before excavating the ground linearly again while the body is kept stopped, and modifying the excavation depth in accordance with the detected change in the body height.

Also, U.S. Pat. No. 4,829,418 proposes another automatic excavation method in which the excavation depth is modified by using a laser beam. This proposed automatic excavation method comprises the steps of setting a desired excavation depth (HTTRGT) with a laser beam as a basis, mounting a laser sensor on an arm, calculating a distance (HTACT) from the laser beam to a bucket prong of a front device at the moment the laser sensor detects the laser beam during excavation, and controlling associated actuators in accordance with a result of comparison between HTTRGT and HTACT so that the bucket prong is moved near the desired excavation depth.

DISCLOSURE OF THE INVENTION

One kind of work to be performed by a hydraulic excavator is slope excavation work. The slope excavation work means work for forming a slope (slope face) over a long distance along a river or road, such as river bank protection work and road side wall work. In such work, the hydraulic excavator takes a posture capable of traveling along the river or road, and an excavator body is moved in the lateral direction relative to the finished slope (i.e., the direction parallel to the river or road) each time after the slope has been finished by excavation in a unit area corresponding to a bucket width. By continuing the above operation repeatedly, a slope (slope face) is formed over a long distance.

When performing such slope excavation in an automatic manner, if a slope face (target slope face) to be formed is set on the basis of the body as a reference as disclosed in International Laid-open Publication WO95/30059, the positional relationship between the body and the finished slope is changed and a step occurs between the slopes because of a difference in level of the ground surface on which the body travels for moving in the lateral direction relative to the slope, or of the body curving while traveling.

Furthermore, if the slope excavation is performed by the methods disclosed in JP, A, 3-295933 and U.S. Pat. No. 4,829,418, change in the direction of height of the body with respect to the finished slope can be compensated when the positional relationship between the body and the finished slope is changed upon movement of the body in the lateral direction relative to the slope. However, change in the back-and-forth direction relative to the slope cannot be compensated and the positional relationship between the body and the finished slope is shifted in the back-and-forth direction. Hence a step still occurs between the slopes.

An object of the present invention is to provide a slope excavation control system for a hydraulic excavator, a target slope face setting system, and a slope excavating method using a hydraulic excavator, with which slope excavation can be performed without causing steps even when the positional relationship between an excavator body and a finished slope is changed upon movement of the body in the lateral direction relative to the slope.

(1) To achieve the above object, according to the present invention, there is provided a slope excavation control system for a hydraulic excavator comprising a plurality of vertically pivotable front members making up a multi-articulated front device, and a body for supporting the front device, the slope excavation control system including excavation plane setting means for setting a target excavation plane to be formed by excavation using the front device, the front device excavating the position of the target excavation plane under area limiting excavation control with which the front device is moved along the target excavation plane when the front device comes close to the target excavation plane, wherein the excavation plane setting means comprises (a) a front reference disposed on the front device and providing a reference for aligning the front device with an external reference provided to extend in the direction of advance of a target slope face; (b) detecting means for detecting status variables in relation to a position and posture of the front device; (c) first calculating means for calculating the position and posture of the front device on the basis of the body from signals of the detecting means; (d) first setting means for setting a positional relationship between the external reference and the target slope face; (e) an external reference setting switch operated when the front reference is aligned with the external reference; (f) second calculating means for calculating a positional relationship between the body and the external reference based on information about the position and posture of the front device calculated by the first calculating means when the external reference setting switch is operated, and calculating a positional relationship between the body and the target slope face from the positional relationship between the body and the external reference and the positional relationship between the external reference and the target slope face set by the first setting means; and (g) second setting means for setting the target slope face as a positional relationship on the basis of the body from the positional relationship between the body and the target slope face calculated by the second calculating means, and defining the set target slope face as the target excavation plane.

In the present invention thus constructed, when the front reference is aligned with the external reference and the external reference setting switch is depressed, the second calculating means modifies the positional relationship between the body and the external reference and calculates the positional relationship between the body and the target slope face set, and the second setting means sets the target slope face as a positional relationship on the basis of the body. Therefore, even when the height of the body is changed with respect to the finished slope upon movement of the body in the lateral direction, excavation work can be performed while compensating change in the body height for each movement of the body. Further, the external reference is provided to extend in the direction of advance of the target slope face, and when the front reference is aligned with the external reference, the above calculation is executed to set the target slope face. Therefore, even when the position of the body in the back-and-forth direction relative to the finished slope is changed upon movement of the body in the lateral direction, excavation work can be performed while compensating change in the position of the body in the back-and-forth direction as well for each movement of the body. As a result, even when the positional relationship between the body and the finished slope is changed upon movement of the body in the lateral direction, a slope extending continuously without steps can be formed by excavation.

(2) In the above (1), preferably, the first setting means is means for setting, as the positional relationship between the external reference and the target slope face, a vertical distance and a horizontal distance from the external reference to a reference point on the target slope face, and angle information of the target slope face.

(3) In the above (1), preferably, the first setting means is means for setting the positional relationship between the external reference and the target slope face based on data input from a setting device.

With those features, the positional relationship between the external reference and the target slope face can be all set by operation of the setting device.

(4) In the above (1), preferably, the first setting means includes means for calculating, based on information about the position and posture of the front device calculated by the first calculating means, a position of an end of the front device taken when the end of the front device is aligned with a reference point on the target slope face, means for calculating, based on the information about the position and posture of the front device calculated by the first calculating means, a position of the front reference taken when the front reference is aligned with the external reference, means for calculating the positional relationship between the external reference and the reference point on the target slope face based on the position of the end of the front device and the position of the front reference, and means for storing the positional relationship calculated by the last-mentioned means and angle data input from a setting device.

With that feature, the positional relationship between the external reference and the target slope face can be set by direct teaching except the angle data.

(5) In the above (1), the first setting means may include means for calculating, based on information about the position and posture of the front device calculated by the first calculating means, a position of an end of the front device taken when the end of the front device is aligned with a first reference point on the target slope face and a position of the end of the front device taken when the end of the front device is aligned with a second reference point on the target slope face, means for calculating angle information of the target slope face based on the positions of the end of the front device at the first and second reference points, means for calculating, based on the information about the position and posture of the front device calculated by the first calculating means, a position of the front reference taken when the front reference is aligned with the external reference, means for calculating a positional relationship between the external reference and one of the first and second reference points on the target slope face based on the position of the end of the front device and the position of the front reference, and means for storing the positional relationship calculated by the means and the angle information.

With that feature, the positional relationship between the external reference and the target slope face can be set, including the angle data, by direct teaching.

(6) Also, to achieve the above object, according to the present invention, there is provided a target slope face setting system for a hydraulic excavator comprising a plurality of vertically pivotable front members making up a multi-articulated front device, and a body for supporting the front device, the front device excavating the position of a preset target excavation plane under area limiting excavation control with which the front device is moved along the target excavation plane when the front device comes close to the target excavation plane, wherein the target slope face setting means comprises (a) an external reference provided to extend in the direction of advance of a target slope face; (b) a front reference disposed on the front device and providing a reference for aligning the front device with the external reference; (c) detecting means for detecting status variables in relation to a position and posture of the front device; (d) first calculating means for calculating the position and posture of the front device on the basis of the body from signals of the detecting means; (e) first setting means for setting a positional relationship between the external reference and the target slope face; (f) an external reference setting switch operated when the front reference is aligned with the external reference; (g) second calculating means for calculating a positional relationship between the body and the external reference based on information about the position and posture of the front device calculated by the first calculating means when the external reference setting switch is operated, and calculating a positional relationship between the body and the target slope face from the positional relationship between the body and the external reference and the positional relationship between the external reference and the target slope face set by the first setting means; and (h) second setting means for setting the target slope face as a positional relationship on the basis of the body from the positional relationship between the body and the target slope face calculated by the second calculating means, and defining the set target slope face as the target excavation plane.

By performing the area limiting excavation control with the target slope face setting system so that the front device is moved along the target excavation plane when the front device comes close to the target excavation plane, a slope extending continuously without steps can be formed by excavation, as mentioned in the above (1), even when the positional relationship between the body and the finished slope is changed upon movement of the body in the lateral direction.

(7) In the above (6), the external reference is, e.g., a leveling string stretched to extend in the direction of advance of the target slope face.

(8) In the above (6), the external reference may comprise a plurality of poles provided in spaced relation in the direction of advance of the target slope face.

(9) In the above (6), the external reference may be a laser beam emitted in the direction of advance of the target slope face.

(10) Further, to achieve the above object, according to the present invention, there is provided a slope excavation method using a hydraulic excavator comprising a plurality of vertically pivotable front members making up a multi-articulated front device, and a body for supporting the front device, the front device excavating the position of a preset target excavation plane under area limiting excavation control with which the front device is moved along the target excavation plane when the front device comes close to the target excavation plane, wherein the slope excavation method comprises the steps of (a) providing an external reference to extend in the direction of advance of a target slope face; (b) setting a positional relationship between the external reference and the target slope face; (c) aligning a front reference provided on the front device with the external reference, calculating a positional relationship between the body and the external reference, calculating a positional relationship between the body and the target slope face from the positional relationship between the body and the external reference and the positional relationship between the external reference and the target slope face set, setting the target slope face as a positional relationship on the basis of the body from the positional relationship between the body and the target slope face, and defining the set target slope face as the target excavation plane; (d) forming a slope in a position of the target slope face by excavation carried out in a current body position of the hydraulic excavator under the area limiting excavation control; (e) moving the body of the hydraulic excavator in the lateral direction relative to the slope formed by excavation in the step (d); (f) carrying out the same steps as the steps (c) and (d) in a body position after movement in the lateral direction; and (g) carrying out the steps (e) and (f) repeatedly.

With the slope excavation method, a slope extending continuously without steps can be formed by excavation, as mentioned in the above (1), even with the positional relationship between the body and the finished slope is changed upon movement of the body in the lateral direction.

(11) In the above (10), preferably, the body of the hydraulic excavator comprises an upper revolving structure supporting the front device and a lower track structure mounting thereon the upper revolving structure in a revolvable manner, the step (d) of forming a slope by excavation is performed with the lower track structure held in a posture parallel to the direction of advance of the target slope face, and the step (e) of moving the body in the lateral direction is performed by traveling the lower track structure in the same posture as in the step (d).

(12) In the above (11), the body of the hydraulic excavator comprises an upper revolving structure supporting the front device and a lower track structure mounting thereon the upper revolving structure in a revolvable manner, the step (d) of forming a slope by excavation may be performed with the lower track structure held in a posture crossing the direction of advance of the target slope face, and the step (e) of moving the body in the lateral direction may be performed by shifting the lower track structure in the transverse direction thereof by moving the lower track structure forward and backward repeatedly in the same posture as in the step (d).

(13) In the above (10), when the target slope face is curved in the direction of advance thereof in the step (a) of providing an external reference, the external reference is also curved in the direction of advance of the curving target slope face.

By thus adjusting the direction in which the external reference extends when installed, a slope can be formed in a direction freely set in conformity with the topography.

BEST MODE FOR CARRYING OUT THE INVENTION

Hereinafter, embodiments of the present invention will be described with reference to the drawings.

A first embodiment of the present invention will be first explained with reference to FIGS. 1 to 11.

Figure 1:
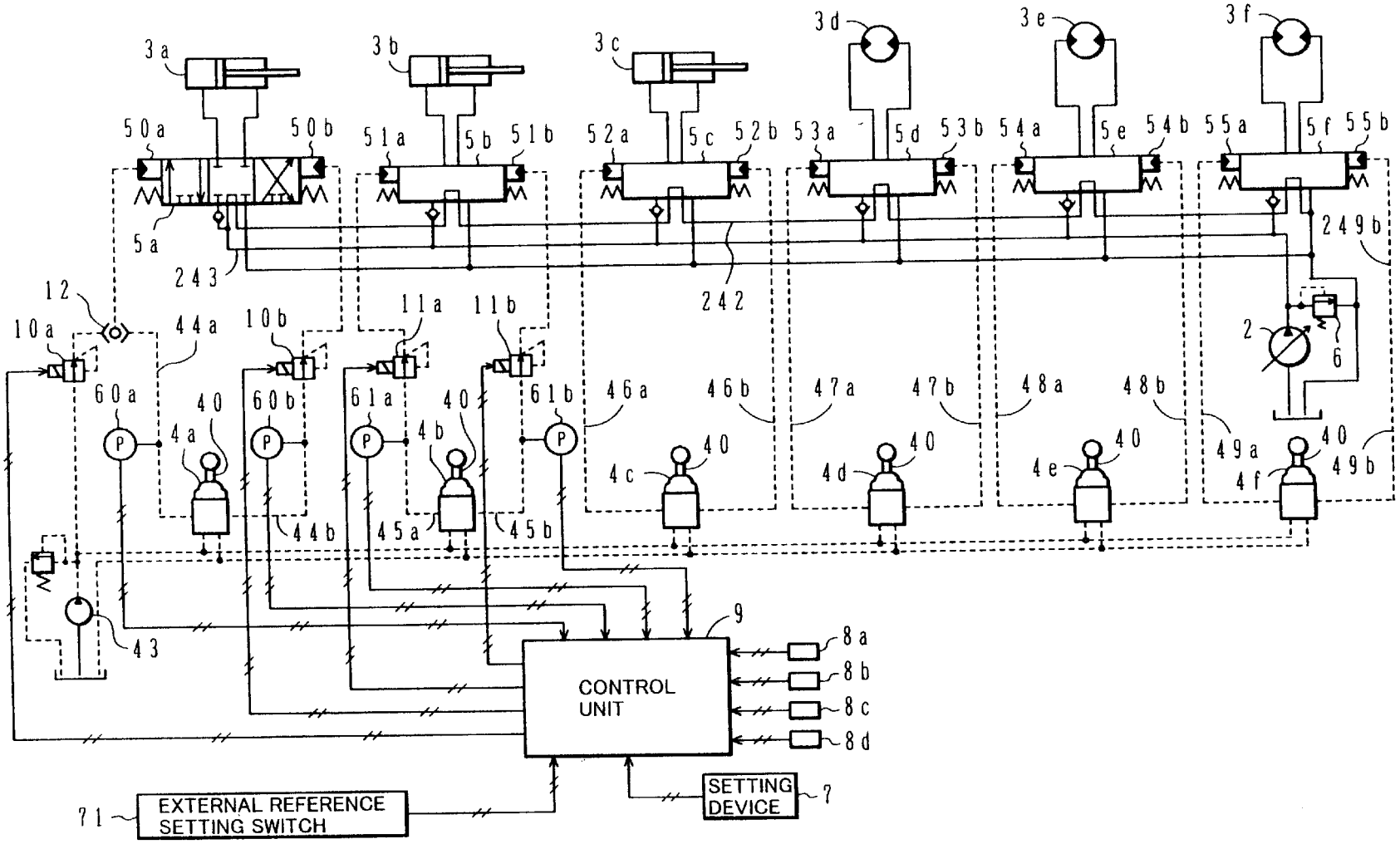
FIG. 1 is a diagram showing a slope excavation control system for a hydraulic excavator according to a first embodiment of the present invention, along with a hydraulic drive system.

In FIG. 1, a hydraulic excavator to which the present invention is applied comprises a hydraulic pump 2, a plurality of hydraulic actuators including a boom cylinder 3*a*, an arm cylinder 3*b*, a bucket cylinder 3*c*, a swing motor 3*d* and left and right track motors 3*e*, 3*f* which are driven by a hydraulic fluid from the hydraulic pump 2, a plurality of control lever units 4*a*–4*f* provided respectively corresponding to the hydraulic actuators 3*a*–3*f*, a plurality of flow control valves 5*a*–5*f* connected between the hydraulic pump 2 and the plurality of hydraulic actuators 3*a*–3*f* for controlling respective flow rates of the hydraulic fluid supplied to the hydraulic actuators 3*a*–3*f*, and a relief valve 6 which is opened when the pressure between the hydraulic pump 2 and the flow control valves 5*a*–5*f* exceeds a preset value.

Figure 2:
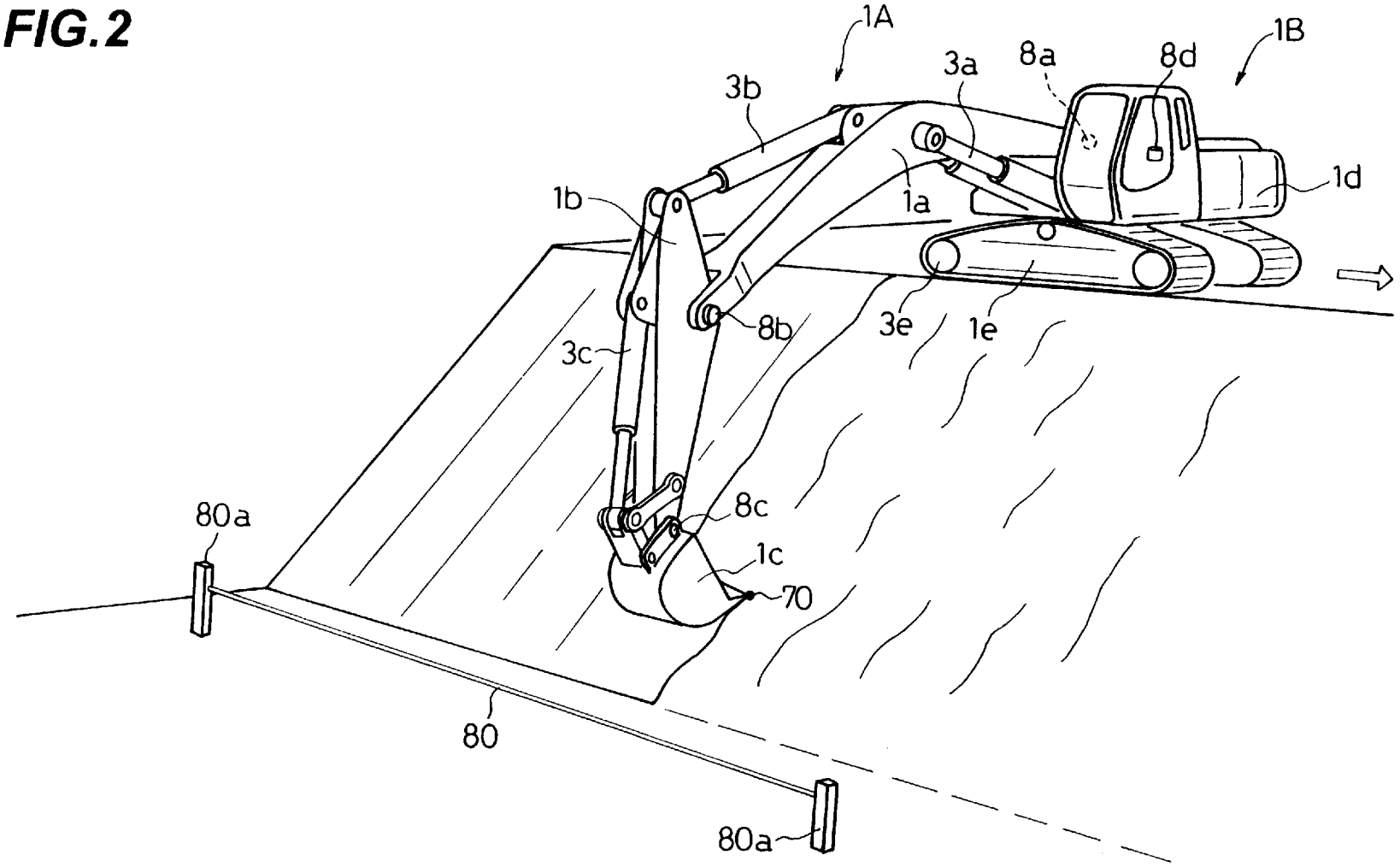
FIG. 2 is a view showing an appearance of a hydraulic excavator to which the present invention is applied, one example of an external reference, and one example of a slope excavating situation.

As shown in FIG. 2, the hydraulic excavator is made up of a multi-articulated front device 1A comprising a boom 1*a*, an arm 1*b* and a bucket 1*c* which are each pivotable in the vertical direction, and a body 1B comprising an upper revolving structure 1*d* which supports the front device 1A, and a lower track structure 1*e* on which the upper revolving structure 1*d* is mounted in a revolvable manner. The boom 1*a* of the front device 1A is supported at its base end to a front portion of the upper revolving structure 1*d*. The boom 1*a*, the arm 1*b*, the bucket 1*c*, the upper revolving structure 1*d* and the lower track structure 1*e* serve as driven members which are driven respectively by the boom cylinder 3*a*, the arm cylinder 3*b*, the bucket cylinder 3*c*, the swing motor 3*d* and the left and right track motors 3*e*, 3*f*. These driven members are operated in accordance with instructions from the control lever units 4*a*–4*f*.

Returning to FIG. 1, the control lever units 4*a*–4*f* are each of hydraulic pilot type driving corresponding ones of the flow control valves 5*a*–5*f* with a pilot pressure. Each of the control lever units 4*a*–4*f* comprises a control lever 40 manipulated by the operator, and a pair of pressure reducing valves (not shown) for generating a pilot pressure depending on the input amount and the direction by and in which the control lever 40 is manipulated. The pressure reducing valves are connected at primary ports to a pilot pump 43, and at secondary ports to corresponding ones of hydraulic driving sectors 50*a*, 50*b*; 51*a*, 51*b*; 52*a*, 52*b*; 53*a*, 53*b*; 54*a*, 54*b*; 55*a*, 55*b* of the flow control valves through pilot lines 44*a*, 44*b*; 45*a*, 45*b*; 46*a*, 46*b*; 47*a*, 47*b*; 48*a*, 48*b*; 49*a*, 49*b*.

A slope excavation control system of the present invention is equipped in the hydraulic excavator constructed as explained above. The control system comprises a setting device 7 for providing an instruction to set a target excavation plane, angle sensors 8*a*, 8*b*, 8*c* disposed respectively at pivot points of the boom 1*a*, the arm 1*b* and the bucket 1*c* for detecting respective rotational angles thereof as status variables in relation to the position and posture of the front device 1A, a tilting sensor 8*d* for detecting a tilting angle θ of the body 1B in the longitudinal direction, pressure sensors 60*a*, 60*b*; 61*a*, 61*b* disposed in the pilot lines 44*a*, 44*b*; 45*a*, 45*b* connected to the boom and arm control lever units 4*a*, 4*b* for detecting respective pilot pressures input from the control lever units 4*a*, 4*b*, a front reference 70 provided at an end (prong) of the bucket 1*c*, an external reference setting switch 71 depressed when the front reference 70 is made aligned with the external reference 80 (described later) through operation of the front device 1A, a control unit 9 for receiving a setup signal of the setting device 7, detection signals of the angle sensors 8*a*, 8*b*, 8*c* and the tilting sensor 8*d*, detection signals of the pressure sensors 60*a*, 60*b*; 61*a*, 61*b* and an input signal of the external reference setting switch 71, setting a front face to be formed (referred to as a target face hereinafter) as the target excavation plane of the hydraulic excavator, and outputting electric signals to perform area limiting excavation control, proportional solenoid valves 10*a*, 10*b*, 11*a*, 11*b* driven by the electric signals output from the control unit 9, and a shuttle valve 12.

The shuttle valve 12 is disposed in the pilot line 44*a* to select a higher one of the pilot pressure in the pilot line 44*a* and the control pressure delivered from the proportional solenoid valve 10*a* and then introduce the selected pressure to the hydraulic driving sector 50*a* of the flow control valve 5*a*. The proportional solenoid valves 10*b*, 11*a*, 11*b* are disposed in the pilot lines 44*b*, 45*a*, 45*b*, respectively, to reduce the pilot pressures in the pilot lines in accordance with the respective electric signals applied thereto and output the reduced pilot pressures.

Further, an external reference 80 representing a reference position for setting the target excavation plane is provided away from the hydraulic excavator. Since a slope face is set as the target excavation plane in the present invention, the external reference 80 is provided to extend in the direction of advance of the slope face.

In the above, a target slope face setting system is constituted by the setting device 7, the front reference 70, the external reference setting switch 71, the angle sensors 8*a*, 8*b*, 8*c*, the tilting sensor 8*d*, the external reference 80, and the following functions of the control unit 9.

Figure 3:
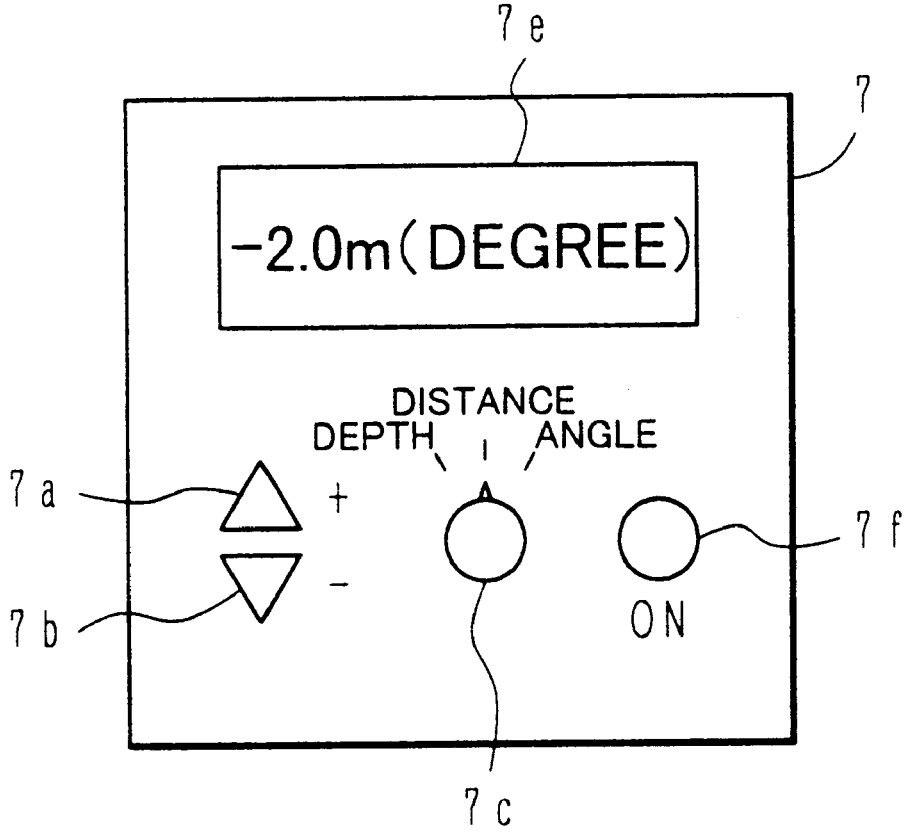
FIG. 3 is a view showing an appearance of a setting device.

The setting device 7 comprises, as shown in FIG. 3, a changeover switch 7*c* for selecting which one of a vertical distance, a horizontal distance and an angle (described later) is to be set for a reference point on the target slope face, up and down buttons 7*a*, 7*b* for entering the vertical distance, horizontal distance and angle of the reference point on the target slope face, a display 7*e* for displaying the entered vertical distance, horizontal distance and angle, and a setting switch 7*f* for outputting the entered vertical distance, horizontal distance and angle as respective setup signals to the control unit 9 to instruct setting of the target slope face. The buttons and so on of the setting device 7 may be provided on a grip of an appropriate control lever. Also, the setting of the target slope face may be instructed by any of other suitable methods such as using IC cards, bar codes, and wireless communication.

Figure 4:
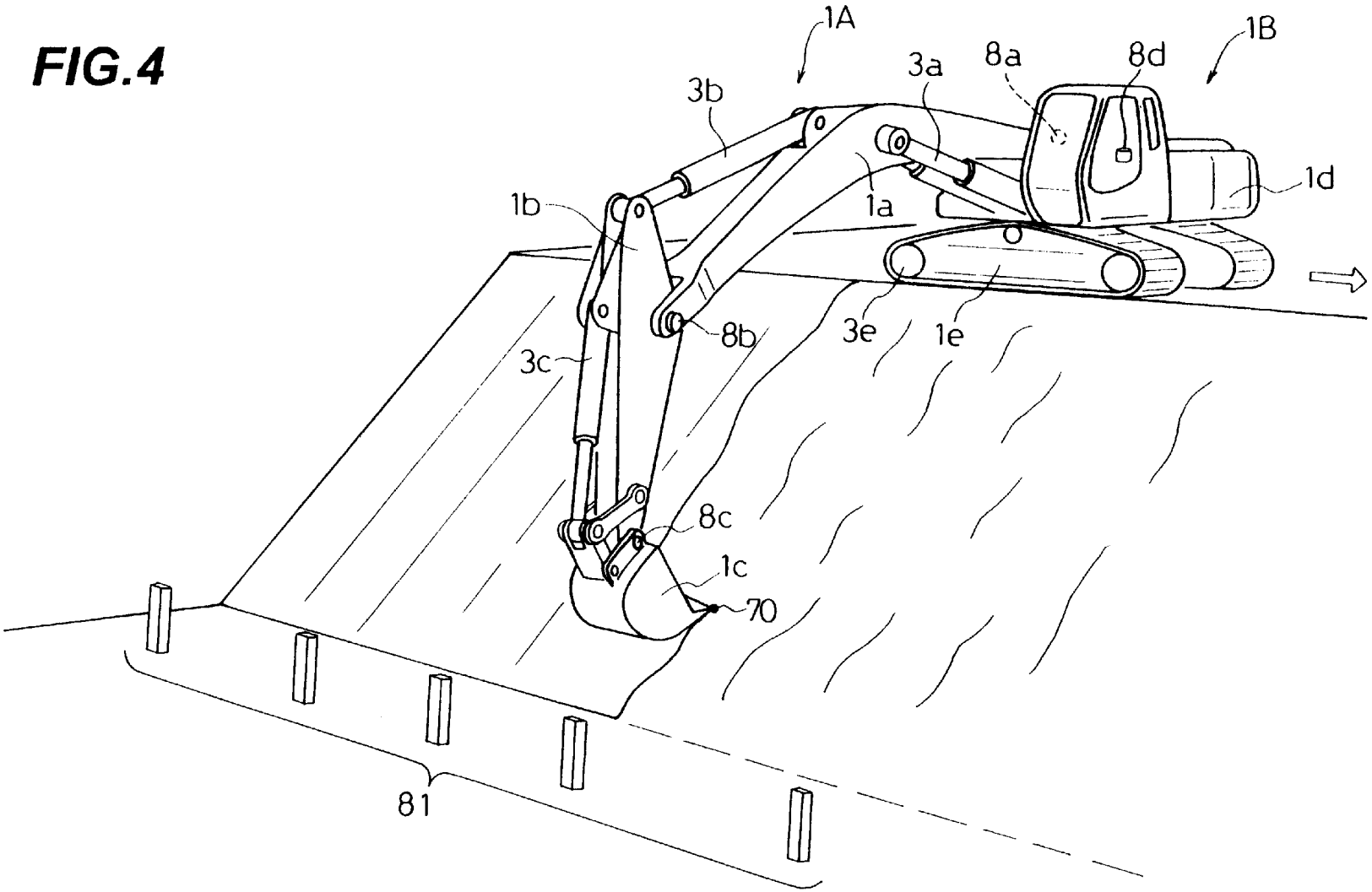
FIG. 4 is a view similar to FIG. 2, the view showing another example of the external reference.

The external reference 80 is, e.g., a leveling string horizontally stretched between poles 80*a* to extend in the direction of advance of the target slope face, as shown in FIG. 2. The leveling string 80 is often used in the job site to indicate a reference line. The external reference may be any other member, e.g., simple poles 81 which are sunk into the ground with intervals therebetween in the direction of advance of the target slope face as shown in FIG. 4, so long as the operator of the hydraulic excavator can confirm the external reference from a cab.

The front reference 70 is set on the prong of the bucket 1*c* of the front device 1A as shown in FIG. 2. Although the front reference is preferably set on the prong of the bucket 1*c*, the front reference may be set in any other suitable position on the front device 1A so long as it locates in such a prescribed position as allowing the operator to easily confirm its alignment with the external reference.

The external reference setting switch 71 is depressed in the above case when the front device 1A is moved to a position where the front reference 70 is aligned with the leveling string as the external reference 80. In response to the depression of the switch 71, the position of the external reference 80 is detected and the positional relationship between the body 1B of the hydraulic excavator and the external reference 80 (i.e., the position of the external reference 80 relative to the body) is set through calculation (as described later).

Figure 5:
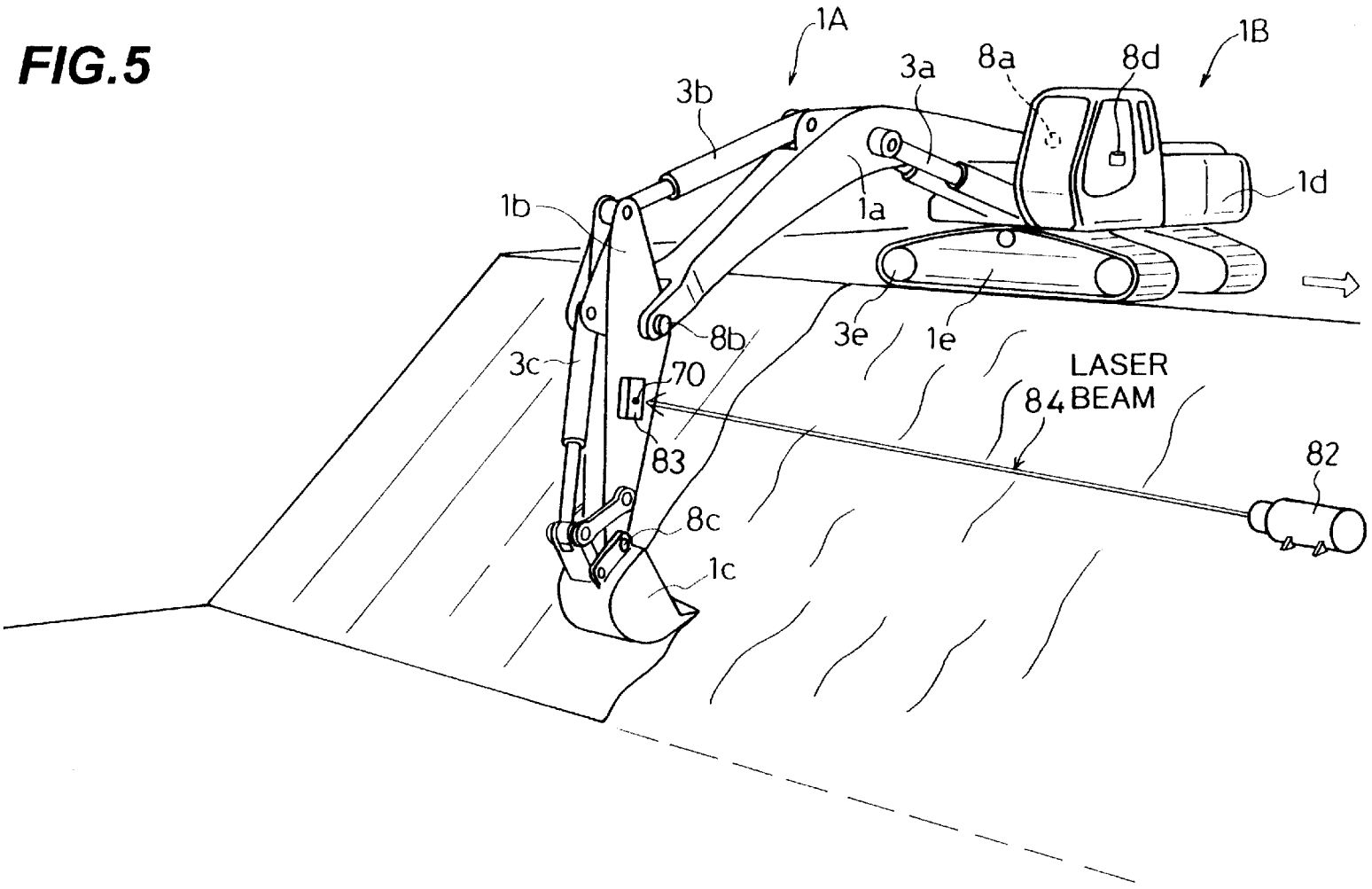
FIG. 5 is a view similar to FIG. 2, the view showing still another example of the external reference.

Alternatively, as shown in FIG. 5, it is also possible to employ, as the external reference, a laser reference beam oscillator (laser lighthouse tube) 82 which is conventionally used for a survey or other purposes in the job site and emits a spot-like laser beam 84, and as the front reference 70, a laser sensor 83 for detecting the laser beam 84. In this case, the laser lighthouse tube 82 is installed such that the laser beam 84 is emitted horizontally in the direction of advance of the target slope face. Also, for the sake of convenience, the laser lighthouse tube 82 is advantageously installed such that the laser beam 84 is located in a middle position of the target slope face. The same function as in the case of using the leveling string or the poles can be achieved by turning on a lamp when the laser beam 84 from the laser lighthouse tube 82 is detected by the laser sensor 83, and depressing the external reference setting switch 71 upon the operator confirming turning-on of the lamp.

Figure 6:
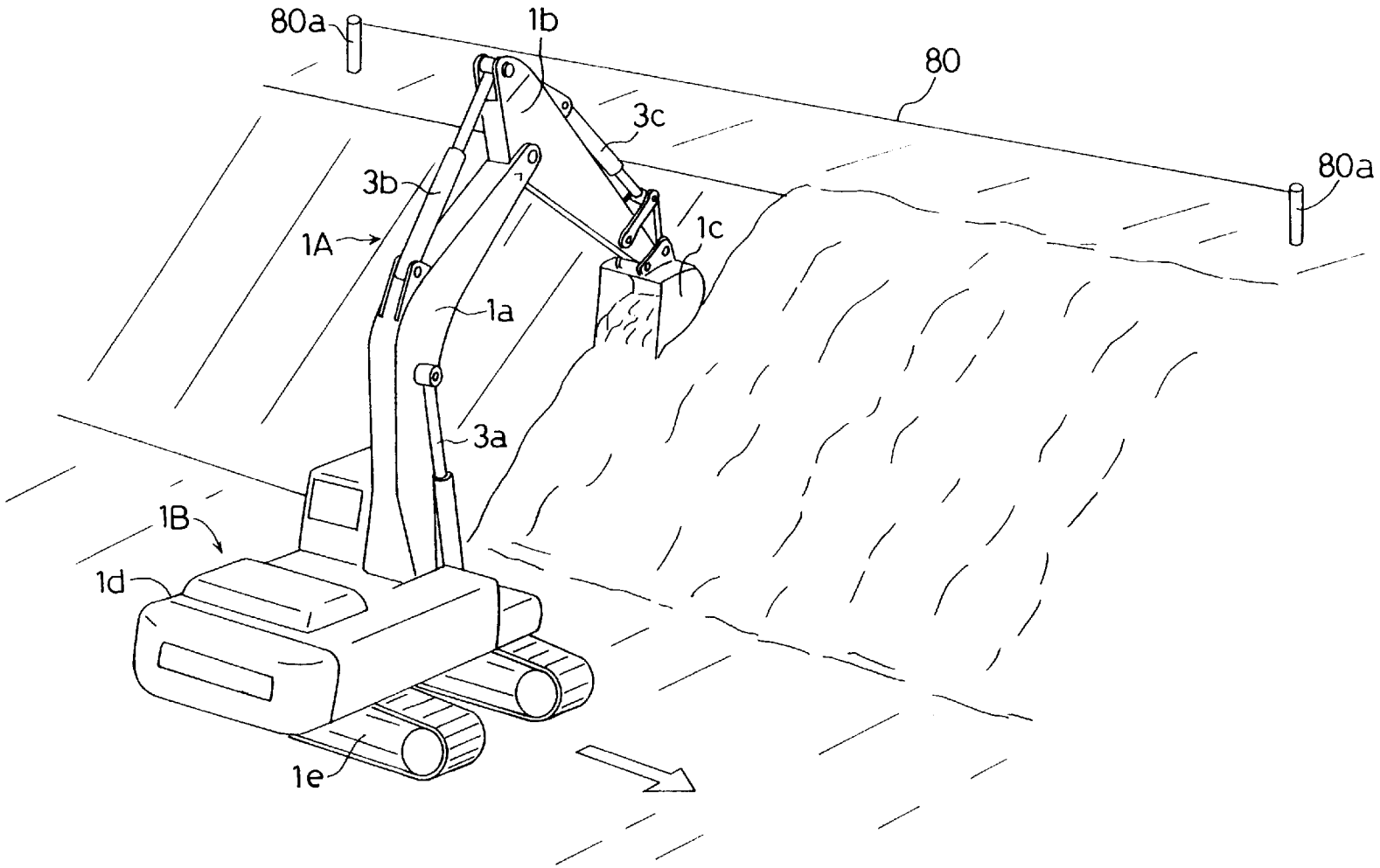
FIG. 6 is a view similar to FIG. 2, the view showing another example of slope excavating situation.

While in FIGS. 4 and 5, by way of example, the body is positioned at the top of the slope and the target slope face is formed by moving the bucket to scrape up earth from below, the target slope face may be formed by positioning the body at the bottom of the slope and moving the bucket to scrape down earth from above, as shown in FIG. 6. The leveling string 80 as the external reference is provided at the top of the slope in FIG. 6, but it may be provided at the bottom of the slope. Alternatively, in the case of employing a laser spot beam, a laser lighthouse tube may be provided in a middle position of the target slope face, as mentioned above.

Figure 7:
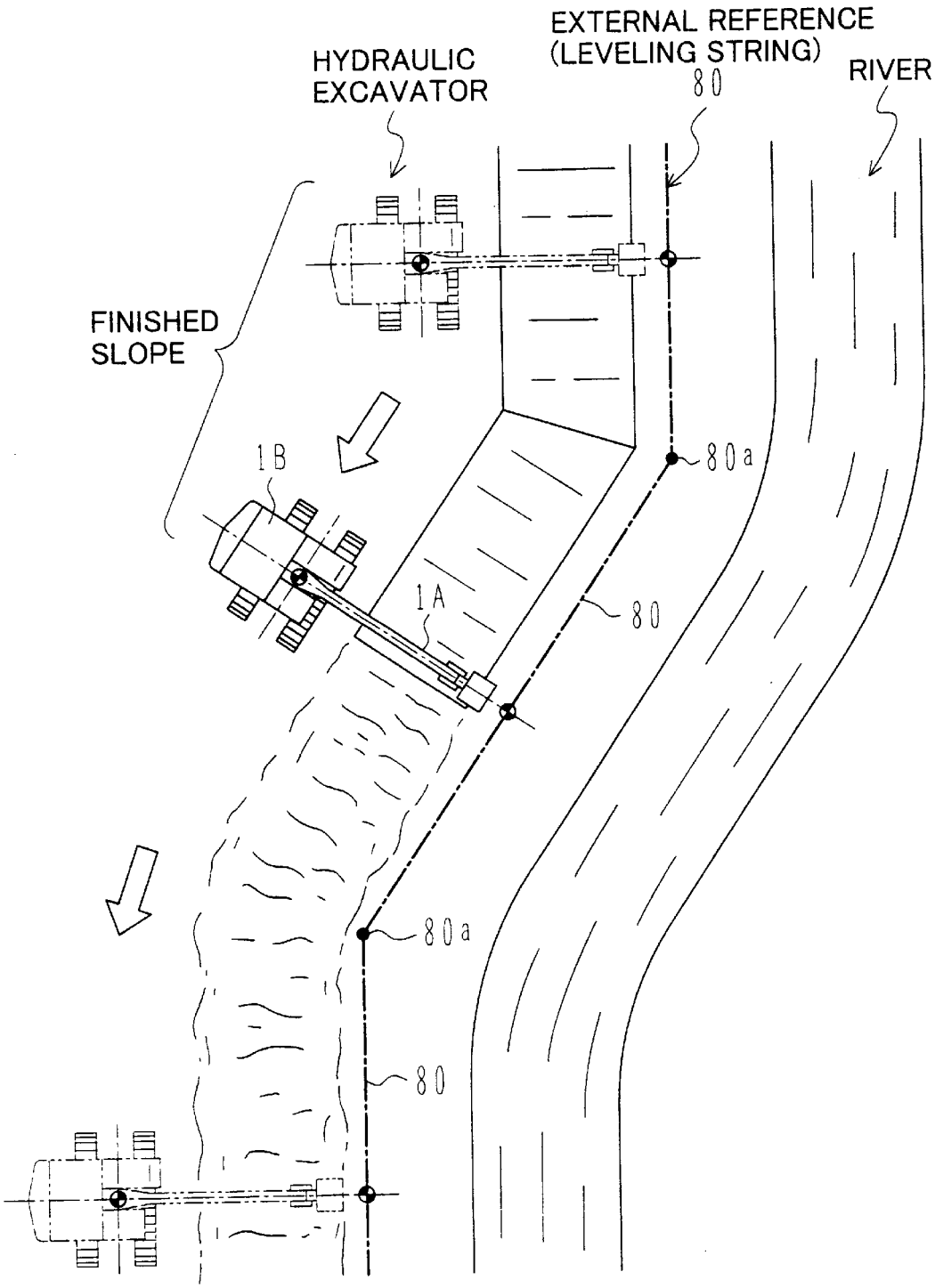
FIG. 7 is a view showing one example of the case where a slope face to be formed by excavation does not lie in one plane, but is curved in the direction of advance of the slope face.

Further, in a practical work site, a slope face to be formed by excavation often does not lie in one plane, but is curved in the direction of advance of the slope face. FIG. 7 shows one example of such a case. In this example, a slope is formed in a bank extending along a river. The bank curves corresponding to curving of the river; hence the slope formed by excavation is also required to curve in the direction of advance of the target slope face following a curve of the bank. When the target slope face is to be curved, the external reference 80 is also provided so as to curve along the target slope face curved in the direction of advance thereof. In the case of the external reference 80 being of a leveling string, the poles 80*a* are sunk into the ground at appropriate corners and a leveling string is stretched between the poles 80*a*.

To minimize the effect of manufacture tolerances of the body in calculation for setting the target slope face when the front reference 70 is set on the arm 1*b* or the boom 1*b*, it is desired that the front reference be disposed as close as possible to the end of the bucket 1*c* to such an extent that working is not interfered with, and aligned with the external reference 80 in a position near the end of the bucket 1*c* which actually acts on earth. The external reference setting switch 71 may be incorporated in the setting device 7.

The control unit 9 sets a target slope face by using the setup signal of the setting device 7 and the detection signals of the external reference setting switch 71, the angle sensors 8*a*, 8*b*, 8*c* and the tilting sensor 8*d*. A manner of setting a target slope face by the control unit 9 and summary of processing functions of the control unit 9 will now be described with reference to FIGS. 8 and 9.

Figure 8:
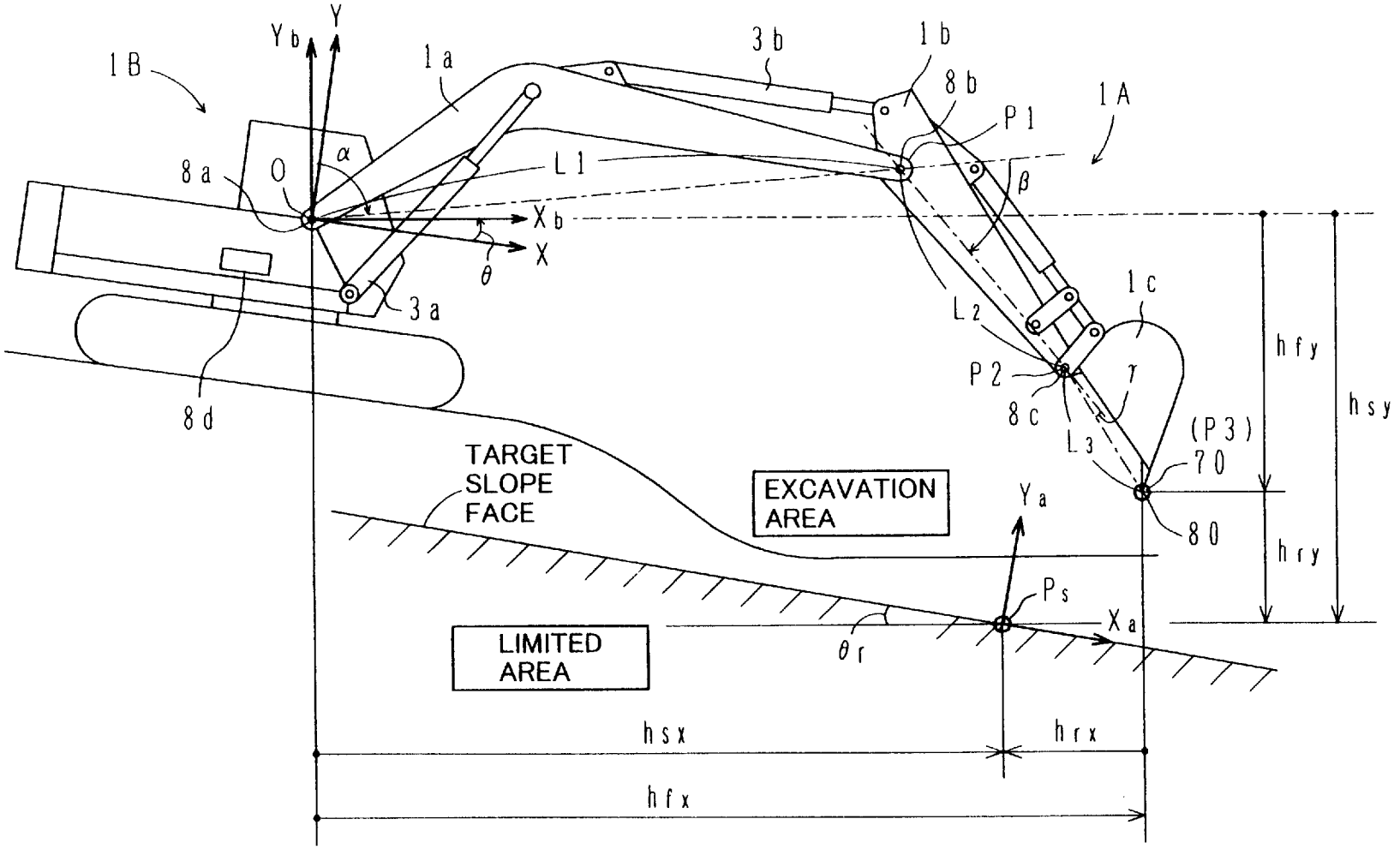
FIG. 8 is an explanatory view showing principles for setting a target slope face according to the first embodiment.

When setting a target slope face, a leveling string, for example, is first stretched as the external reference 80, as described above, away from the body of a hydraulic excavator to extend in the direction of advance of the target slope face, as shown in FIGS. 2 and 8.

Then, the operator enters a vertical distance hry and a horizontal distance hrx from the external reference 80 to a reference point Ps on a target slope face to be set, as well as an angle θr of the target slope face relative to the horizontal by using the setting device 7, thus setting the positional relationship between the external reference 80 and the target slope face based on the vertical distance hry, the horizontal distance hrx and the angle θr. In other words, the target slope face is set on the basis of the position of the external reference 80. This setting is executed by a processing function of first setting means 100 of the control unit 9 shown in FIG. 9.

The vertical distance and the horizontal distance from the external reference 80 to the reference point on the target slope and the angle of the target slope face are set in the first setting means 100 as follows. A place where the external reference is to be installed is decided, and the vertical distance and the horizontal distance from the external reference to the reference point on the target slope and the angle of the target slope face are determined by referring to the working drawings, etc. beforehand. The operator inputs numeral values of those parameters by using the changeover switch 7*c* and the buttons 7*a*, 7*b* of the setting device 7. Upon confirming the input numeral values on the display 7*e*, the operator depresses the setting switch 7*f* for decision. When it is determined that the setting switch 7*f* is depressed, the control unit 9 stores these vertical distance, the horizontal distance and angle as hry, hrx and θr, respectively.

Next, a target slope face is set in accordance with the positional relationship on the basis of the current body position of the hydraulic excavator. To this end, the operator first moves the front device 1A so that the front reference 70 set to the prong of the bucket 1*c* of the front device 1A is aligned with the external reference 80. Upon the alignment between both the references, the operator depresses the external reference setting switch 71. While the front device 1A is being moved, the current position and posture of the front device 1A are calculated in the control unit 9 by a processing function of first calculating means 120, shown in FIG. 9, based on the signals of the angle sensors 8*a*, 8*b*, 8*c* and the tilting sensor 8*d*. When the front reference 70 set to the prong of the bucket 1*c* of the front device 1A is aligned with the external reference 80 and the operator depresses the external reference setting switch 71, a vertical distance hfy and a horizontal distance hfx from the center O of the body to the external reference 80 are calculated as the positional relationship between the body 1B and the external reference 80 by a processing function of second calculating means 140, shown in FIG. 9, based on information about the position and posture of the front device 1A obtained by the first calculating means 120 at that time. Further, by using the vertical distance hfy and the horizontal distance hfx as modification values, a vertical distance hsy and a horizontal distance hsx from the body center O to the reference point Ps on the target slope face are calculated from the previously set vertical distance hry and the horizontal distance hrx (i.e., the positional relationship between the external reference 80 and the excavation area). Then, the vertical distance hsy, the horizontal distance hsx, and the angle θr input by the setting device 7 are set as defining the target slope face on the basis of the body 1B of the hydraulic excavator by a processing function of second setting means 160 shown in FIG. 9.

Figure 10:
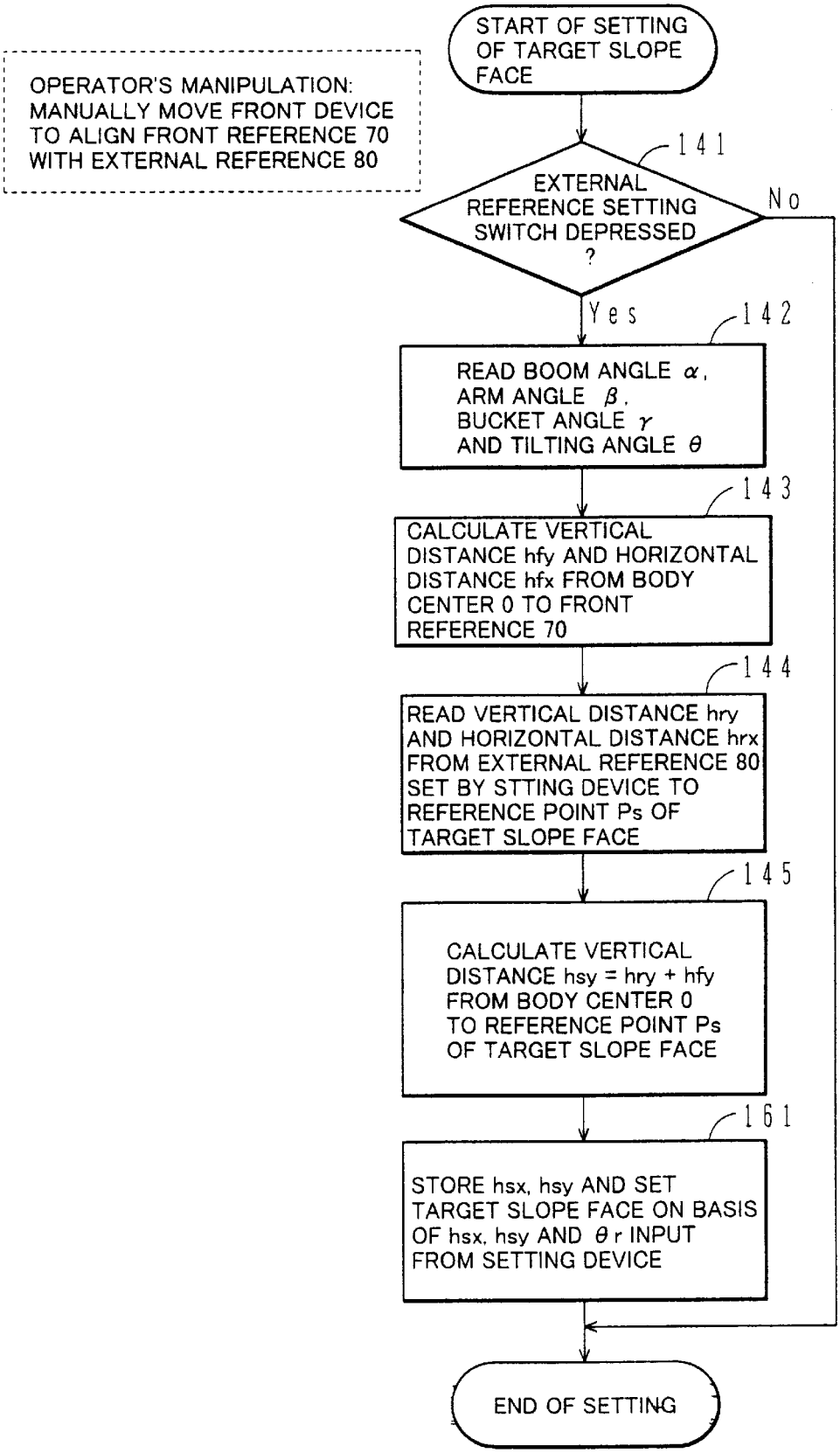
FIG. 10 is a flowchart showing a process flow of second calculating means and second setting means in the first embodiment.

Details of the function of setting the positional relationship between the body and the target slope face in the second calculating means 140 and the second setting means 160 is shown in a process flow chart of FIG. 10.

First, as indicated in a block circumscribed by broken lines, the operator manipulates the control levers 40 (see FIG. 1) to move the front device 1A so that the front reference 70 is aligned with the external reference 80. Then, the control unit 9 determines in step 141 whether the external reference setting switch 71 is depressed by the operator or not. If not depressed, the control unit 9 brings the setting process to an end without changing the setting of the target slope face. If the external reference setting switch 71 is determined in step 141 as being depressed, the control unit 9 goes to step 142.

In step 142, the control unit 9 reads respective angles α, β, γ of the boom 1*a*, the arm 1*b* and the bucket 1*c* and a tilting angle θ of the body 1B from the angle sensors 8*a*, 8*b*, 8*c* and the tilting sensor 8*d* which are provided on the front device 1A. Next, in step 143, the vertical distance hfy and the horizontal distance hsx from the body center O to the front reference 70 taken when the external reference setting switch 71 is depressed (i.e., when the front reference 70 is aligned with the external reference 80), is calculated from the angles α, β, γ of the boom, the arm and the bucket and the tilting angle θ.

In this calculation process, a vertical distance hby and a horizontal distance hbx from the body center O to the joint point P1 between the boom and the arm (i.e., the point where the arm angle sensor 8*b* is mounted) are first determined from the following formulae (1) and (2):

$$hby=L1\times\cos(\alpha-\theta) \quad (1)$$

$$hbx=L1\times\sin(\alpha-\theta) \quad (2)$$

In the formulae (1) and (2), L1 represents a distance from the joint point between the boom l*a* and the body 1B (i.e., the point where the boom angle sensor 8*a* is mounted), namely the body center O, to the joint point P1 between the boom and the arm. A value of the distance L1 is known and stored in the control unit 9 beforehand.

Then, a vertical distance hay and a horizontal distance hax from the joint point P1 between the boom and the arm to the joint point P2 between the arm and the bucket are determined from the following formulae (3) and (5):

$$hay=L2\times\cos((\alpha-\theta)+\beta) \quad (4)$$

$$hax=L2\times\sin((\alpha-\theta)+\beta) \quad (5)$$

In the formulae (4) and (5), L2 represents a length from the joint point P1 between the boom and the arm to the joint point P2 between the arm and the bucket, and is stored in the control unit 9 beforehand.

Next, a vertical distance hcy and a horizontal distance hcx from the joint point P2 between the arm and the bucket to the prong P3 of the bucket are determined from the following formulae (6) and (7):

$$hcy=L3\times\cos((\alpha-\theta)+\beta+\gamma) \quad (6)$$

$$hcy=L3\times\sin((\alpha-\theta)+\beta+\gamma) \quad (7)$$

In the formulae (6) and (7), L3 represents a length from the joint point P2 between the arm and the bucket to the prong P3 of the bucket, and is stored in the control unit 9 beforehand.

Subsequently, the vertical distance hfy and the horizontal distance hfx from the body center O to the front reference 70 (i.e., the bucket prong P3) are calculated from the following formulae (7) and (8) based on hay, hax, hby, hbx, hcy and hcx calculated above:

$$hfy=hay+hby+hcy \quad (8)$$

$$hfx=hax+hbx+hcx \quad (9)$$

Next, the control unit 9 goes to step 144 for reading the vertical distance hry and the horizontal distance hrx from the external reference 80 to the reference point on the target slope face which has been set by using the setting device 7.

Then, in step 145, by using as modification values the above-calculated vertical distance hfy and horizontal distance hbx from the body center O to the front reference 70, the vertical distance hsy and the horizontal distance hsx from the body center O to the reference point on the target slope face are calculated from the following formulae (10) and (11) based on those values hfy, hfx and the vertical distance hry and the horizontal distance hrx from the external reference 80 to the reference point on the target slope face which has been set by using the setting device 7:

$$hsy=hry+hfy \quad (10)$$

$$hsx=hrx+hfx \quad (11)$$

Finally, in step 161, the control unit 9 stores the vertical distance hsy and the horizontal distance hsx which have been calculated in step 145 for the reference point on the target slope face, and sets the target slope face from those distances hsy, hsx and the angle or input from the setting device 7 on the basis of the body.

Figure 9:
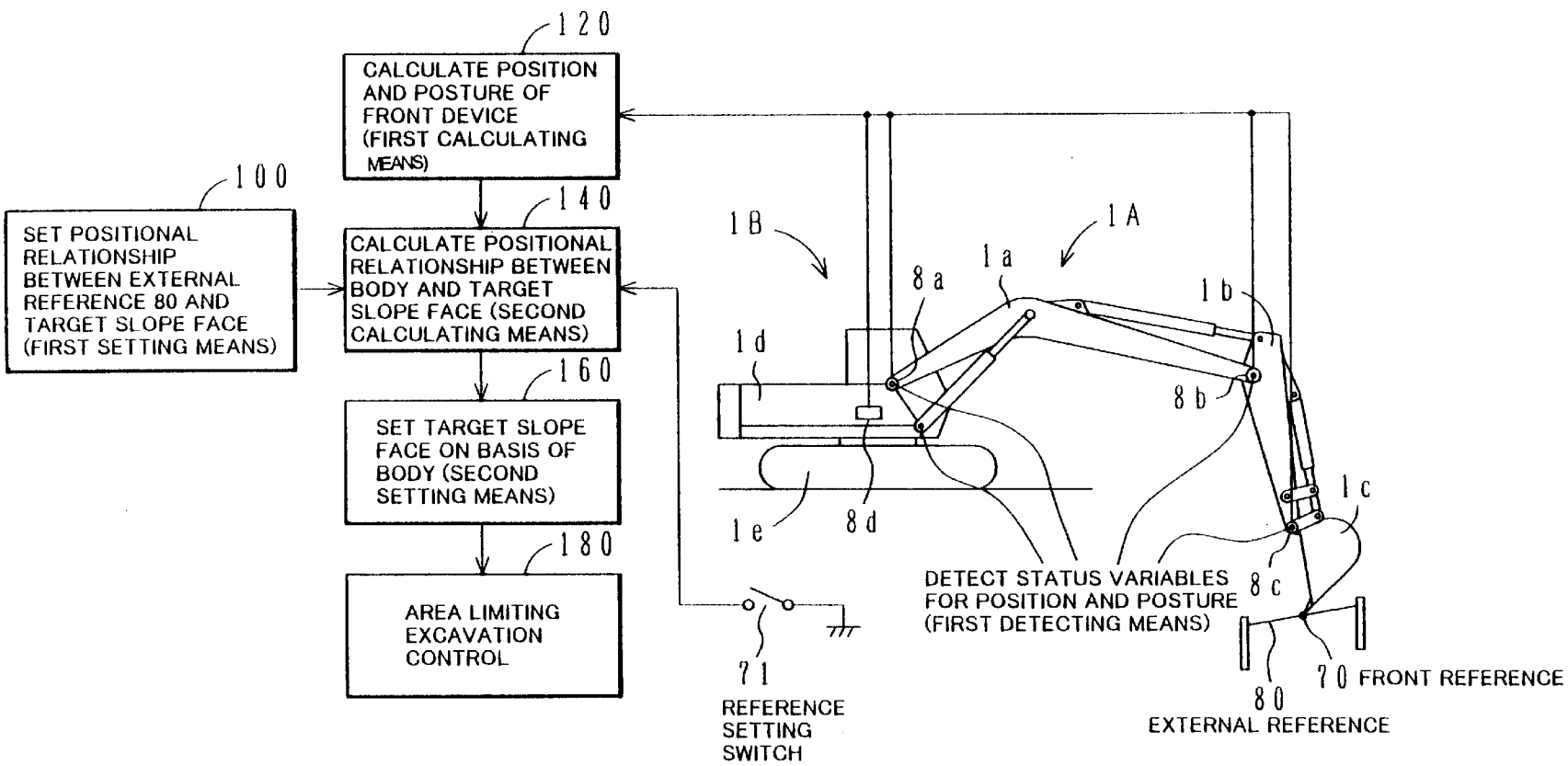
FIG. 9 is a conceptual diagram showing an entire configuration of the slope excavation control system according to the first embodiment.

In the foregoing process flow, the steps 141–145 correspond to the processing function of the second calculating means 140 shown in FIG. 9, and the step 161 corresponds to the processing function of the second setting means 160 shown in FIG. 9.

When the setting of the target slope face on the basis of the body 1B of the hydraulic excavator is completed as described above, the hydraulic excavator starts excavation work under the area limiting excavation control shown in block 180 of FIG. 9 to form a slope in match with the target slop face by excavation carried out in the current position.

After the slope has been formed in match with the target slop face by excavation carried out by the hydraulic excavator in the current position, the body of the hydraulic excavator is moved to a new position in the lateral direction relative to the finished slope as indicated by arrow in FIGS. 4–7. In the new position, the above-mentioned steps are executed again by the second calculating means 140 and the second setting means 160. Specifically, the front reference 70 is aligned with the external reference 80 and the external reference setting switch 71 is depressed to set a target slope face on the basis of the body 1B in the new position after movement. The hydraulic excavator carries out excavation work under the area limiting excavation control to form a slope in match with the target slop face in that position.

Usually, the hydraulic excavator takes such a posture that the lower track structure 1*e* is oriented parallel to a slope (target slope face) to be formed, as shown in FIGS. 4–7, and carries out excavation to form the slope in the posture. The body is moved in the lateral direction by traveling the excavator in the same posture. As an alternative, similar operation can also be achieved by orienting the lower track structure 1*e* to position perpendicular to the slope, carrying out excavation to form the slope in the posture, and moving the body in the lateral direction by shifting the body in parallel relation (i.e., shifting the body transversely by moving the lower track structure 1*e* forward and backward repeatedly while it is kept in the posture oriented perpendicular to the slope.

Thus, the slope in match with the target slope face is successively formed along the external reference 80 by repeatedly executing the step of moving the hydraulic excavator in the lateral direction, setting a target slope face on the basis of the body in a new position, and forming the slope under the area limiting excavation in that position.

Entire control functions of the control unit 9 including the above-described target slope face setting function will now be described with reference to FIG. 11.

Figure 11:
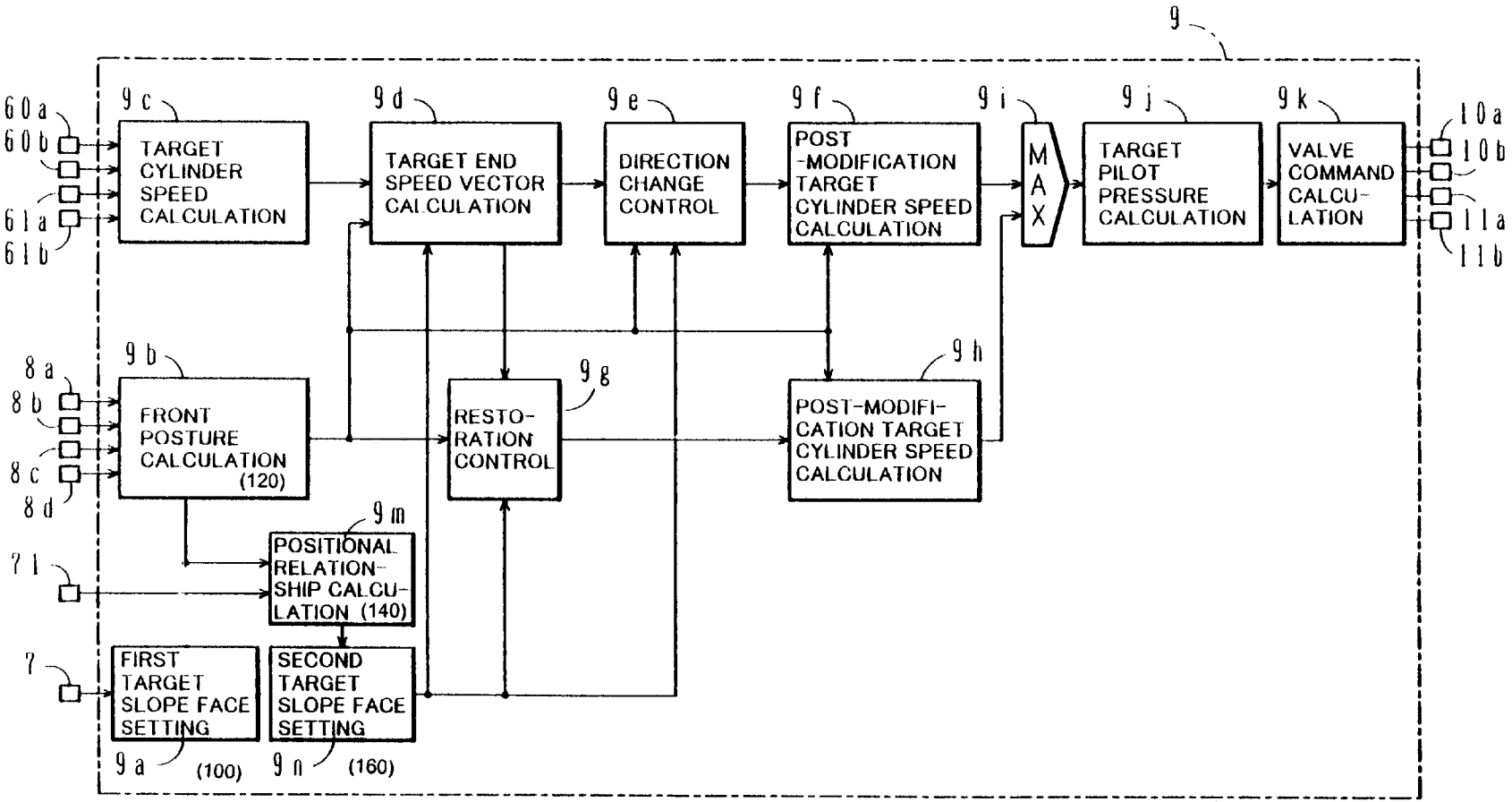
FIG. 11 is a functional block diagram showing entire control functions of a control unit.

In FIG. 11, the control unit 9 includes functions executed by a first target slope face setting portion 9*a*, a front posture calculating portion 9*b*, a target cylinder speed calculating portion 9*c*, a target end speed vector calculating portion 9*d*, a direction change control portion 9*e*, a post-modification target cylinder speed calculating portion 9*f*, a restoration control calculating portion 9*g*, a post-modification target cylinder speed calculating portion 9*h*, a target cylinder speed selector 9*i*, a target pilot pressure calculating portion 9*j*, a valve command calculating portion 9*k*, a positional relationship calculating portion 9*m*, and a second target slope face setting portion 9*n*.

The first target slope face setting portion 9*a* corresponds to the first setting means 100 in FIG. 9 and sets the positional relationship between the external reference 80 and the target slope face based on the vertical distance hry and the horizontal distance hrx from the external reference 80 to the reference point Ps on the target slope face, as well as the angle θr of the target slope face with operation of the setting device 7.

The front posture calculating portion 9*b* corresponds to the first calculating means 120 in FIG. 9 and calculates the position and posture of the front device 1A necessary for setting and control based on various dimensions of the front device 1A and the body 1B which are stored in the control unit 9, rotational angles α, β, γ detected respectively by the angle sensors 8*a*, 8*b*, 8*c*, and a tilting angle θ detected by the tilting sensor.

The positional relationship calculating portion 9*m* corresponds to the second calculating means 140 in FIG. 9 and calculates the vertical distance hsy and the horizontal distance hsx from the body center O to the reference point on the target slope face through the steps 141–145 of the process flow shown in FIG. 10.

The second target slope face setting portion 9*n* corresponds to the second setting means 160 in FIG. 9 and sets the target slope face in accordance with the positional relationship on the basis of the body 1B of the hydraulic excavator from the aforementioned vertical distance hsy, the horizontal distance hsx and the angle θr in the step 161 of the process flow shown in FIG. 10.

In the front posture calculating portion 9*b*, the position and posture of the front device 1A are calculated on an XY-coordinate system with the origin defined by the pivot point of the boom 1*a*. The XY-coordinate system is a rectangular coordinate system fixed on the body 1B and is assumed to lie in a vertical plane. Given that the distance between the pivot point of the boom 1*a* and the pivot point of the arm 1*b* is L1, the distance between the pivot point of the arm 1*b* and the pivot point of the bucket 1*c* is L2, and the distance between the pivot point of the bucket 1*c* and the end of the bucket 1*c* is L3, the end position of the bucket 1*c* of the front device 1*c* is determined as coordinate values on the XY-coordinate system are from formulae below:

$$X=L1 \sin \alpha+L2 \sin(\alpha+\beta)+L3 \sin(\alpha+\beta+\gamma)$$

$$Y=L1 \cos \alpha+L2 \cos(\alpha+\beta)+L3 \cos(\alpha+\beta+\gamma)$$

When the body 1B is inclined as shown in FIG. 8, the relative positional relationship between the bucket end and the ground surface is changed and thus the setting of the target slope face cannot be performed correctly. In this embodiment, therefore, the tilting angle θ of the body 1B is detected by the tilting sensor 8*d* and a detected value of the tilting angle θ is input to the front posture calculating portion 9*b* so that it can make calculation for the position of the bucket end on an XbYb-coordinate system which is provided by rotating the XY-coordinate system through the angle θ. This enables the setting to be correctly performed even if the body 1B is inclined. Note that the tilting sensor is not always required when work is started after correcting a tilting of the body if the body is inclined, or when excavation is performed in the work site where the body will not incline.

In the first target slope face setting portion 9*a*, the positional relationship calculating portion 9*m* and the second target slope face setting portion 9*n*, the vertical distances hry, hsy, hfy, the horizontal distances hrx, hsx, hfx, etc. are processed after being transformed into respective values on the XbYb-coordinate system.

The target cylinder speed calculating portion 9*c* receives the detection signals of the pressure sensors 60*a*, 60*b*; 61*a*, 61*b* as operation signals input from the control lever units 4*a*, 4*b*. From the operations signals (pilot pressures), the calculating portion 9*c* calculates target supply flow rates through the flow control valves 5*a*, 5*b* (target speeds of the boom cylinder 3*a* and the arm cylinder 3*b*).

The target end speed vector calculating portion 9*d* determines a target speed vector Vc at the end of the bucket 1*c* from the position of the bucket end determined by the front posture calculating portion 9*b*, the target cylinder speed determined by the target cylinder speed calculating portion 9*c*, and the various dimensions, such as L1, L2 and L3, stored in the control unit 9. At this time, the target speed vector Vc is calculated as values on an XaYa-coordinate system shown in FIG. 8. The XaYa-coordinate system is defined by setting, as the origin thereof, a point on the XbYb-coordinate system given by the horizontal distance hsx and the vertical distance hsy from the body center O to the reference point on the target slope face which are determined by the second target slope face setting portion 9*n*, and then inclining the XaYa-coordinate system by the angle θr of the target slope face with respect to the XbYb-coordinate system so that the Xa-coordinate axis lies in the slope face. Here, an Xa-coordinate component Vcx of the target speed vector Vc on the XaYa-coordinate system represents a vector component of the target speed vector Vc in the direction parallel to the target slope face, and a Yc-coordinate component Vcy thereof represents a vector component thereof in the direction vertical to the target slope face.

When the end of the bucket 1*c* is positioned within the target slope face (excavation area) near it and the target speed vector Vc has a component in the direction toward the target slope face, the direction change control portion 9*e* modifies the vertical vector component such that it is gradually reduced as the bucket end comes closer to the target slope face. In other words, a vector (reversed vector) being smaller than the vector component Vcy in the vertical direction and orienting away from the target slope face is added to the vector component Vcy.

By modifying the vector component Vcy of the target speed vector Vc as described above, the vertical vector component Vcy is reduced such that the amount of reduction in the vector component Vcy is increased as a distance Ya decreases. Thus, the target speed vector Vc is modified into a target speed vector Vca. Here, the range of a distance Ya1 from the target slope face can be called a direction change area or a slowdown area.

Figure 12:
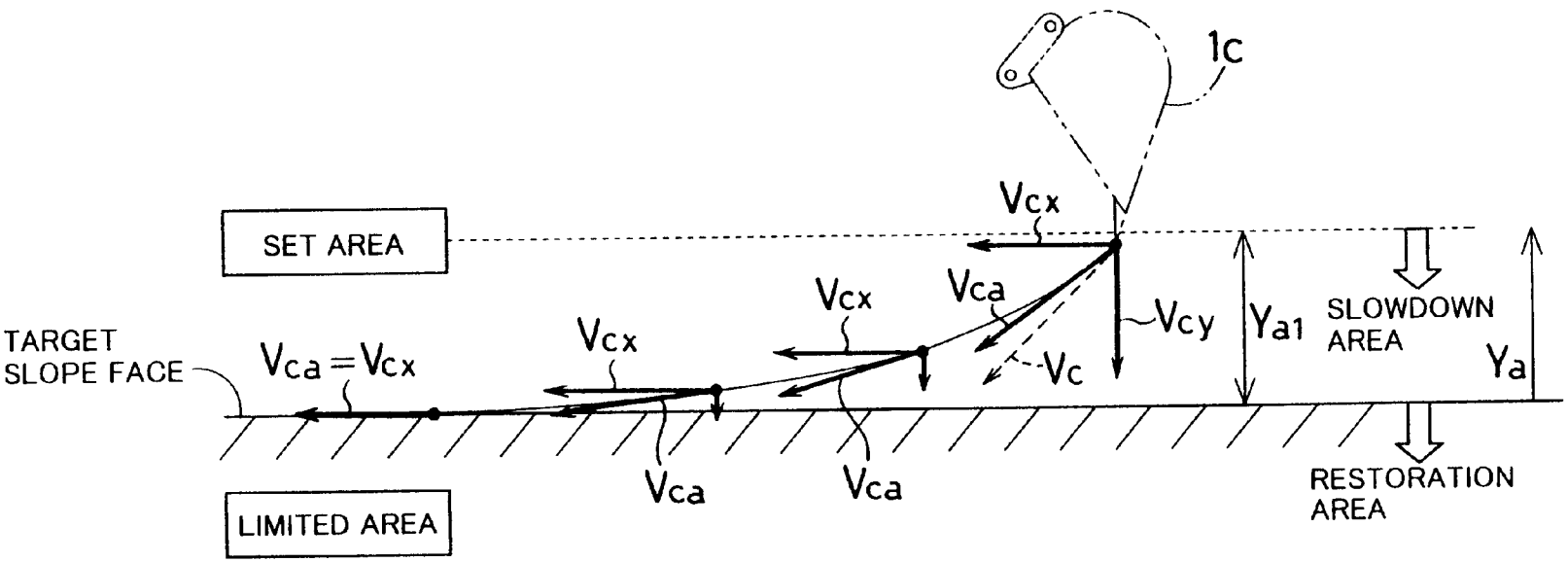
FIG. 12 is a diagram showing one example of a path along which a bucket end is moved as per calculation during area limiting excavation control when direction change control is performed.

FIG. 12 shows one example of a path along which the end of the bucket 1*c* is moved when the direction change control is performed as per the above-described target speed vector Vca after modification. Given that the target speed vector Vc is oriented downward obliquely and constant, its parallel component Vcx remains the same and its vertical component Vcy is gradually reduced as the end of the bucket 1*c* comes closer to the target slope face (i.e., as the distance Ya decreases). Because the target speed vector Vca after modification is a resultant of both the parallel and vertical components, the path is in the form of a curved line which is curved to become parallel by degrees while approaching the target slope face, as shown in FIG. 9. At the time the end of the bucket 1*c* reaches the target slope face, the vertical vector component Vcy of the target speed vector Vc becomes 0 and the target speed vector Vca after modification coincides with Vcx.

The post-modification target cylinder speed calculating portion 9*f* calculates target cylinder speeds of the boom cylinder 3*a* and the arm cylinder 3*b* from the target speed vector after modification determined by the direction change control portion 9*e*. This process is a reversal of the calculation executed by the target end speed vector calculating portion 9*d*.

In the restoration control portion 9*g*, when the end of the bucket 1*c* exceeds the target slope face and enters the outside (limited area) thereof, the target speed vector is modified depending on the distance from the target slope face so that the bucket end is returned to the inside of the target slope face. In other words, a vector (reversed vector) being larger than the vector component Vcy in the vertical direction and orienting toward the target slope face is added to the vector component Vcy. By thus modifying the vertical vector component Vcy of the target speed vector Vc, the target speed vector Vc is modified into a target speed vector Vca such that the vertical vector component Vcy is reduced as the distance Ya decreases.

Figure 13:
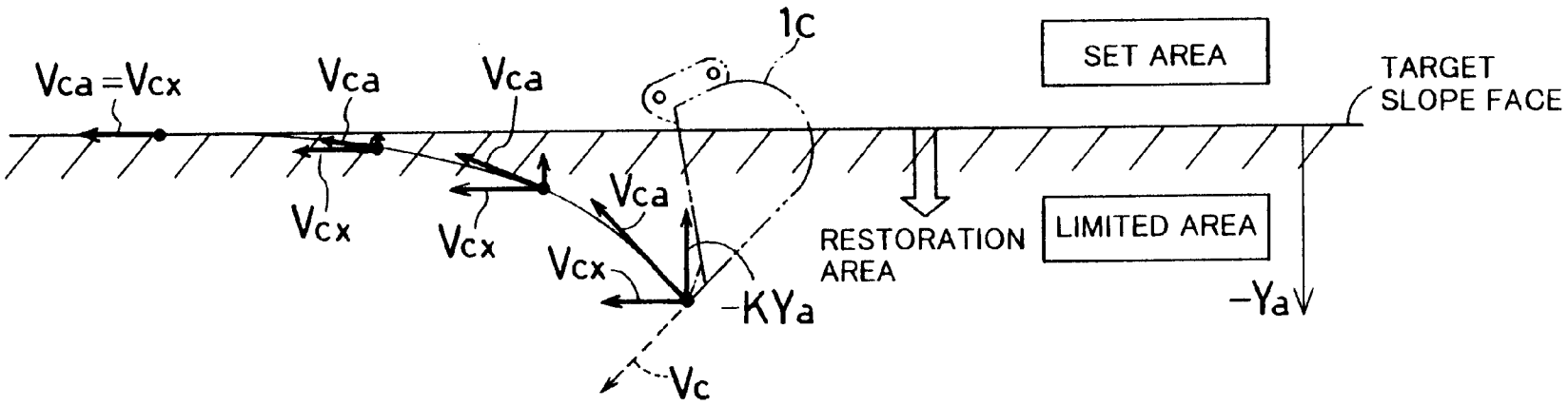
FIG. 13 is a diagram showing one example of a path along which the bucket end is moved as per calculation during the area limiting excavation control when restoration control is performed.

FIG. 13 shows one example of a path along which the end of the bucket 1*c* is moved when the restoration control is performed as per the above-described target speed vector Vca after modification. Given that the target speed vector Vc is oriented downward obliquely and constant, its parallel component Vcx remains the same and a restoration vector—KYa is proportional to the distance Ya such that a vertical component is gradually reduced as the end of the bucket 1*c* comes closer to the target slope face (i.e., as the distance Ya decreases). Because the target speed vector Vca after modification is a resultant of both the parallel and vertical components, the path is in the form of a curved line which is curved to become parallel by degrees while approaching the target slope face, as shown in FIG. 13. On the target slope face, the target speed vector Vca after modification coincides with Vcx.

Thus, since the end of the bucket 1*c* is controlled to return to the inside of the target slope face by the restoration control portion 9*g*, a restoration area is defined outside the target slope face. In the restoration control, the movement of the end of the bucket 1*c* toward the target slope face is also slowed down and, eventually, the direction in which the end of the bucket 1*c* is moving is converted into the direction along the target slope face. In this meaning, the restoration control can also be called direction change control.

The post-modification target cylinder speed calculating portion 9*h* calculates target cylinder speeds of the boom cylinder 3*a* and the arm cylinder 3*b* from the target speed vector after modification determined by the restoration control portion 9*g*. This process is a reversal of the calculation executed by the target end speed vector calculating portion 9*d*.

When the restoration control is performed, the directions in which the boom cylinder and the arm cylinder are required to be operated to achieve the restoration control are selected and the target cylinder speeds in the selected operating directions are calculated. Since the bucket end is returned to the set area by raising the boom 1*a* in the restoration control, the direction of raising the boom 1*a* is always included. The combination of boom-up and any other mode is also determined in accordance with the control software.

The target cylinder speed selector 9*i* selects larger one (maximum value) of a value of the target cylinder speed determined by the target cylinder speed calculating portion 9*f* for the direction change control and a value of the target cylinder speed determined by the target cylinder speed calculating portion 9*h* for the restoration control, and then sets the selected value as a target cylinder speed to be output.

The target pilot pressure calculating portion 9*j* calculates, as the target pilot pressures, target pilot pressures to be produced in the pilot lines 44*a*, 44*b*; 45*a*, 45*b*.

The valve command calculating portion 9*k* calculates command values corresponding to the target pilot pressures calculated by the target pilot pressure calculating portion 9*j*, and outputs electric signals corresponding to the command values to the proportional solenoid valves 10*a*, 10*b*, 11*a*, 11*b*.

This embodiment constructed as described above can provide the advantages set forth below.

(1) Each time the front reference 70 is aligned with the external reference 80 and the external reference setting switch 71 is depressed, the positional relationship between the external reference 80 and the body 1B is modified and the positional relationship between the body and the target slope face is calculated, enabling the target slope face to be set on the basis of the body. Therefore, even when the height of the body is changed with respect to the finished slope upon movement of the body in the lateral direction, excavation work can be performed while compensating change in the body height for each movement of the body. Further, the external reference 80 is provided to extend horizontally in the direction of advance of the target slope face, and when the front reference is aligned with the external reference 80, the above calculation is executed to set the target slope face. Therefore, even when the position of the body in the back-and-forth direction relative to the finished slope is changed upon movement of the body in the lateral direction, excavation work can be performed while compensating change in the position of the body in the back-and-forth direction as well for each movement of the body. As a result, even when the positional relationship between the body and the finished slope is changed upon movement of the body in the lateral direction, a smooth slope extending continuously without steps can be formed by excavation.

The above point will be described with reference to FIGS. 14A and 14B. In FIG. 14, (A) represents the positional relationship at the time the target slope face is set, and (B) represents the positional relationship after the body is moved.

Figure 14A:
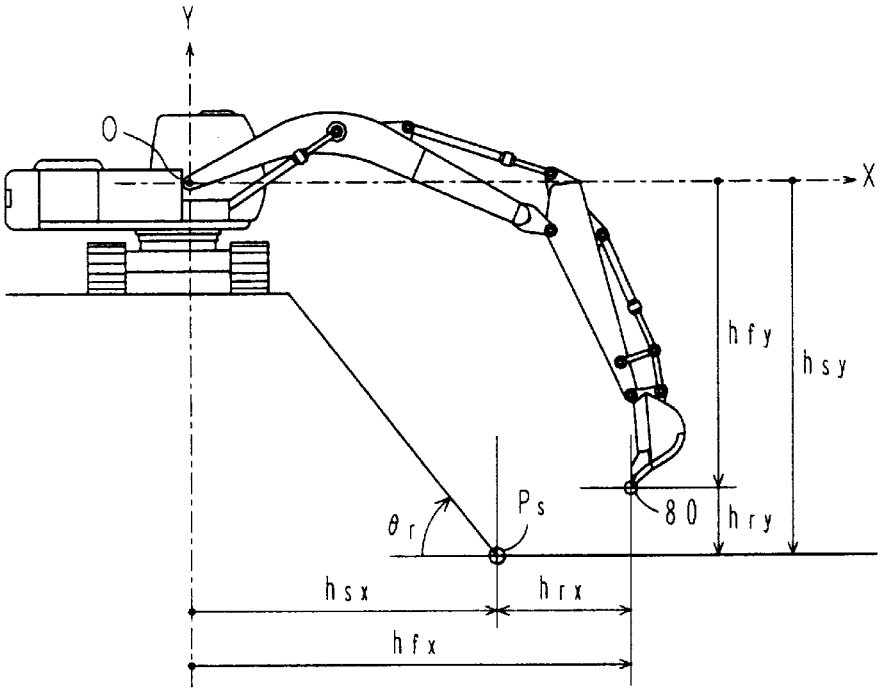
FIG. 14 is a view showing the relationship between an excavator body and the external reference between an initial setting state where the target slope face is set and FIG. 14B shows a state after the body is moved from the initial setting state shown in FIG. 14A.
Figure 14B:
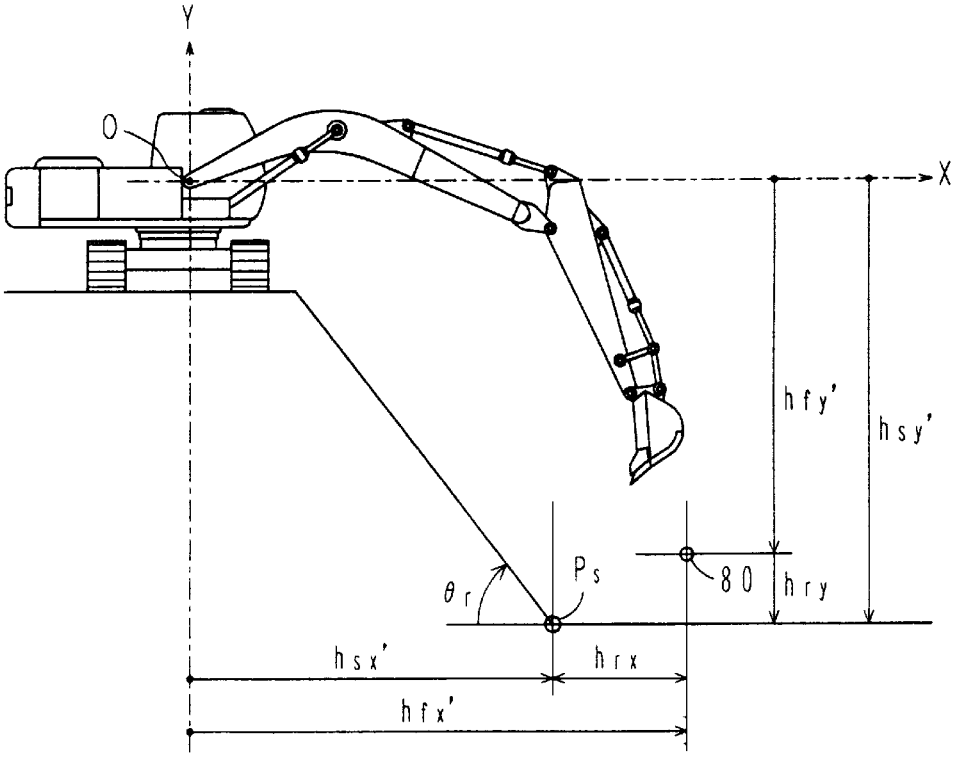

In FIG. 14(A), the vertical distance hsy and the horizontal distance hsx from the body center O to the reference point Ps on the target slope face are determined in the step 145 of FIG. 10 based on the vertical distance hry and the horizontal distance hrx which are input by the first setting means 100 in FIG. 9, and the vertical distance hfy and the horizontal distance hfx are determined as modification values by the second calculating means 140 in FIG. 9 and the step 143 in FIG. 10. A target slope face is set in the step 161 of FIG. 10 based on the vertical distance hsy and the horizontal distance hsx thus determined, and the angle θr input by using the setting device 7. A slope is formed by excavation carried out under excavation limiting control using those set data hsx, hsy and θr.

When the excavation to form the slope is completed in the position of FIG. 14(A), the body is moved in the lateral direction to change a position where excavation is to be carried out. At this time, as shown in FIG. 14(B), the vertical distance hsy and the horizontal distance hsx from the body center O to the reference point Ps on the target slope face are changed respectively to hsy' and hsx'. However, each time the front reference 70 is aligned with the external reference 80 and the external setting switch 71 is depressed by the operator, modification values hfy' and hfx' at that time are determined and the vertical distance and the horizontal distance from the body center O to the reference point Ps on the target slope face are updated to hsy' and hsx'. Accordingly, the target slope face is always set in the same position with respect to the external reference 80, and a smooth slope extending continuously without steps can be formed.

(2) Since the external reference 80 is provided to extend horizontally in the direction of advance of the target slope face and a slope is formed in match with the target slope face by excavation along the external reference 80, the slope successively formed eventually extends parallel to the external reference 80. By adjusting the direction in which the external reference 80 extends when installed, therefore, the slope can be formed in a direction freely set in conformity with the topography. For example, in the case of forming a slope in the bank curving along a river as mentioned above, the poles 80*a* are sunk into the ground following a curve of the bank and the leveling string (external reference) 80 is stretched between the poles 80*a*. By so providing the external reference, the target slope face can be set parallel to the leveling string 80 and a curved slope can be easily formed in conformity with the curve of the bank.

(3) The front reference 70 is set to the prong of the bucket 1*c* as a member which actually acts on the ground, and the target slope face on the basis of the body 1B is set based on the position and posture of the front device 1A taken when the front reference 70 is aligned with the external reference 80 and the external reference setting switch 71 is depressed. Therefore, the effect of errors, such as manufacture tolerances of the body 1B or tolerances in accuracy and mounting of the front reference 70, the angle sensors 8*a*–8*c*, etc. upon the setting of the target slope face is offset through the calculation for setting the target slope face and the calculation for the excavation control. Accordingly, when the end position of the bucket 1*c* is calculated in the excavation control, a calculation result is less affected by the above-mentioned tolerances and other errors in accuracy than the conventional method of detecting reference light by a sensor mounted on the body, and excavation can be precisely performed as per the setting with a smaller difference from the set target slope face.

This point will now be described below in more detail. In the related art disclosed in the above-cited JP, A, 3-295933, the body height can be compensated with the aid of reference light as stated before. When excavation is performed in the related art, the body height is modified and control is made so that a bucket end is moved to a vertical distance hs set with respect to the body center. At this time, a control unit executes calculation and control to position the bucket end at the position of hs based on dimensions L1, L2, L3 of a boom, an arm and a bucket stored in a memory and angles α, β, γ of front members detected by angle sensors. However, the actual front members include manufacture errors, and the boom, the arm and the bucket actually have dimensions of, e.g., L1+εL1, L2+εL2 and L3+εL3, respectively. Also, the angles α, β, γ detected by the angle sensors include respective errors εα, εβ, εγ due to mounting errors of the sensors, detection errors of the sensors themselves, etc. relative to true angles α', β', γ'. Therefore, even when the control unit attempts to make control to move the bucket end to;

hs (L1, L2, L3, α(hs), β(hs), γ(hs))

a position to which the bucket end is actually moved is given by:

$$hs'(L1', L', L3', \alpha'(hs), \beta'(hs), \gamma'(hs)) = hs'(L1+\epsilon L1, L2+\epsilon L2, L3+\epsilon L3, \alpha(hs)+\epsilon\alpha, \beta(hs)+\epsilon\beta, \gamma(hs)+\epsilon\gamma) \quad (6)$$

where L1, L2, L3: design values

α, β, γ: detected values

L1', L2', L3', α', β', γ': actual values

εL1, εL2, εL3, εα, εβ, εγ: errors

L1'=L1+εL1

L2'=L2+εL2

L3'=L3+εL3

α=α'+εα

β=β'+εβ

γ=γ'+εγ and where α(hs), β(hs), γ(hs), α'(hs), β'(hs), γ'(hs) represent detected values and actual values of the respective angles taken when the front device is in a posture of detecting the vertical distance hs.

Assuming a target boom angle to be 30°, for example, the control unit controls the front device so that the detected value $\alpha(hs)$ is 30° ($\alpha(hs)=30°$). At this time, if there is an error $\epsilon\alpha=0.5°$ between the detected value $\alpha$ and the actual angle $\alpha'$, the front device would be actually controlled to the position of $\alpha'=30.5°$.

On the other hand, in this embodiment, since the front reference 70 is provided on the front device (bucket end), the position hf (hfx, hfy) taken by the front reference 70 when it is aligned with the external reference 80, is recognized by the control unit 9 as a position calculated below:

hf (L1, L2, L3, $\alpha$(hf), $\beta$(hf), $\gamma$(hf))

At this time, the front reference 70 actually locates in a position below:

$$hf'(L1', L2', L3', \alpha'(hf), \beta'(hf), \gamma'(hf)\theta f') = hf'(L1+\epsilon L1, L2+\epsilon L2, L3+\epsilon L3, \alpha(hf)+\epsilon\alpha, \beta(hf)+\epsilon\beta, \gamma(hf)+\epsilon\gamma) \quad (12)$$

A position of the bucket end at this time is the same as given above. In the formula (12):

$\alpha$(hf), $\beta$(hf), $\gamma$(hf): detected values of the angles when the front device is in the posture of detecting hf $\alpha'$(hf), $\beta'$(hf), $\gamma'$(hf): actual values of the angles when the front device is in the posture of detecting hf At this time, since the front reference 70 is in the true position of the external reference 80, this means that the control unit 9 has detected the true position of the external reference 80 including errors. If that position hf is employed in the area limiting excavation control, an error between the detected position hf in the control unit 9 and the actual position hf' is the same as that included at the time of detecting hf. Therefore, both the errors offset each other and the actual position hf' of the front reference 70 is aligned with the true position.

For example, assuming that the actual boom angle is $\alpha'=30°$ and the detected value of the sensor 8*a* includes an error $\epsilon\alpha=0.5°$ when the external reference 80 is detected, the boom angle is detected by the control unit as being $\alpha=29.5°$. When the boom is controlled so as to take a target angle using the detected value $\alpha=29.5°$, it is actually controlled to the position of $\alpha'=30°$, i.e., it is aligned with the true position of the external reference 80. Thus, the error is cancelled out.

Next, when the position of the bucket end is controlled by using, as a target, hs (hsx, hsy) modified based on hf during the area limiting excavation control, the error included in at least hf is canceled out looking from the actual position of the external reference, as mentioned above, and the remaining error is an error due to the sensors caused when the bucket end is moved from the posture of detecting hf to a posture of detecting hs. In the posture of detecting hs, the bucket end is actually in a position below:

$$hs'(L1', L2', L3', \alpha', \beta'(hs), \gamma'(hs)) = hs'(L1+\epsilon L1, L2+\epsilon L2, L3+\epsilon L3, \alpha(hs)+\epsilon\alpha(hs), \beta(hs)+\epsilon\beta(hs), \gamma(hs)+\epsilon\gamma(hs)) \quad (13)$$

where $\alpha$(hs), $\beta$(hs), $\gamma$(hs): detected values of the angles when the front device is controlled to the posture of detecting hs $\alpha'$(hs), $\beta'$(hs), $\gamma'$(hs): actual values of the angles when the front device is controlled to the posture of detecting hs At this time, in this embodiment, since the bucket end position in the posture of detecting hf is aligned with the true position of the external reference 80 in accordance with the formula (12), errors relating to deviations $\alpha(hs)-\alpha(hf)$, $\beta(hs)-\beta(hf)$, $\gamma(hs)-\gamma(hf)$ occurred when the bucket end is controlled to move from the posture of detecting hf to the posture of detecting hs, i.e.,;

$$\Delta\epsilon\alpha=\epsilon\alpha(hs)-\epsilon\alpha(hf) \quad (14)$$

$$\Delta\epsilon\beta=\epsilon\beta(hs)-\epsilon\beta(hf) \quad (15)$$

$$\Delta\epsilon\gamma=\epsilon\gamma(hs)-\epsilon\gamma(hf) \quad (16)$$

are produced as actual errors when the area limiting excavation control is performed, and hence are much smaller than in the prior art.

Further, according to this embodiment, by providing the front reference 70 on the front device 1A to make change between the posture of setting the external reference position and the posture during excavation as small as possible, the errors produced in relation to the above formulae (14) to (16) can be further reduced in such a case.

Incidentally, when employing a direct teaching method described later, since an error in setting hr (hrx, hry) is also taken in at the time of the setting and the bucket end is controlled to move to hr while canceling out the error, more precise excavation control can be achieved.

(4) In the related art disclosed in the above-cited JP, A, 3-295933, the reference light sensor provided on the body is required to be able to cover a wide range for positive detection of the reference light. By contrast, in this embodiment, since the front device 1A is operated to make the front reference 70 aligned with the external reference 80 and the external reference setting switch 71 is then depressed to effect the setting, the front reference 70 provided on the front device 1A can be formed of the bucket prong itself or a small and simple member such as an arrow mark of a steel plate, and the movement of the body can be compensated without needing a large-sized and complicated sensor.

Similarly, since the front device 1A is operated to make the front reference 70 aligned with the external reference 80 and the external reference setting switch 71 is then depressed to effect the setting, the movement of the body can be compensated over a wide range because of the front device 1A being movable over a wide range.

(5) In the related art disclosed in the above-cited JP, A, 3-295933, the reference light sensor provided on the body is required to be able to cover a wide range for positive detection of the reference light, as stated above, and this requirement poses a great restriction in a level of the reference light, taking into account the size of the reference light sensor. By contrast, in this embodiment, since the front reference 70 is set on the front device 1A, particularly the bucket prong, a place where the external reference member 80 is installed is not subjected to substantial restrictions because of the front device being movable over a wide range. This leads to such a merit that when there is no appropriate place on the ground capable of installing the external reference at the same level as the body 1B, the external reference 80 can be installed in a lower position such as in a trench, for example, than the body as shown in FIG. 8. In this connection, it is also possible to install the external reference 80 in view of the above-mentioned problem of errors so that change between the posture of positioning the front reference to be aligned with the external reference and the posture during excavation is reduced, and hence to improve the accuracy of excavation.

(6) Since the external reference 80 is installed away from the body to extend horizontally in the direction of advance of the target slope face, it require does not to be changed in its position after once installed, and can be employed as a reference for the target slope face continuously even when the body is moved from one position to another.

(7) Since a deviation occurred upon movement of the body is compensated by using the external reference each time the body is moved, labor and time necessary for the operator to measure the deviation and make setting again by suspending the excavation control can be omitted.

Figure 15:
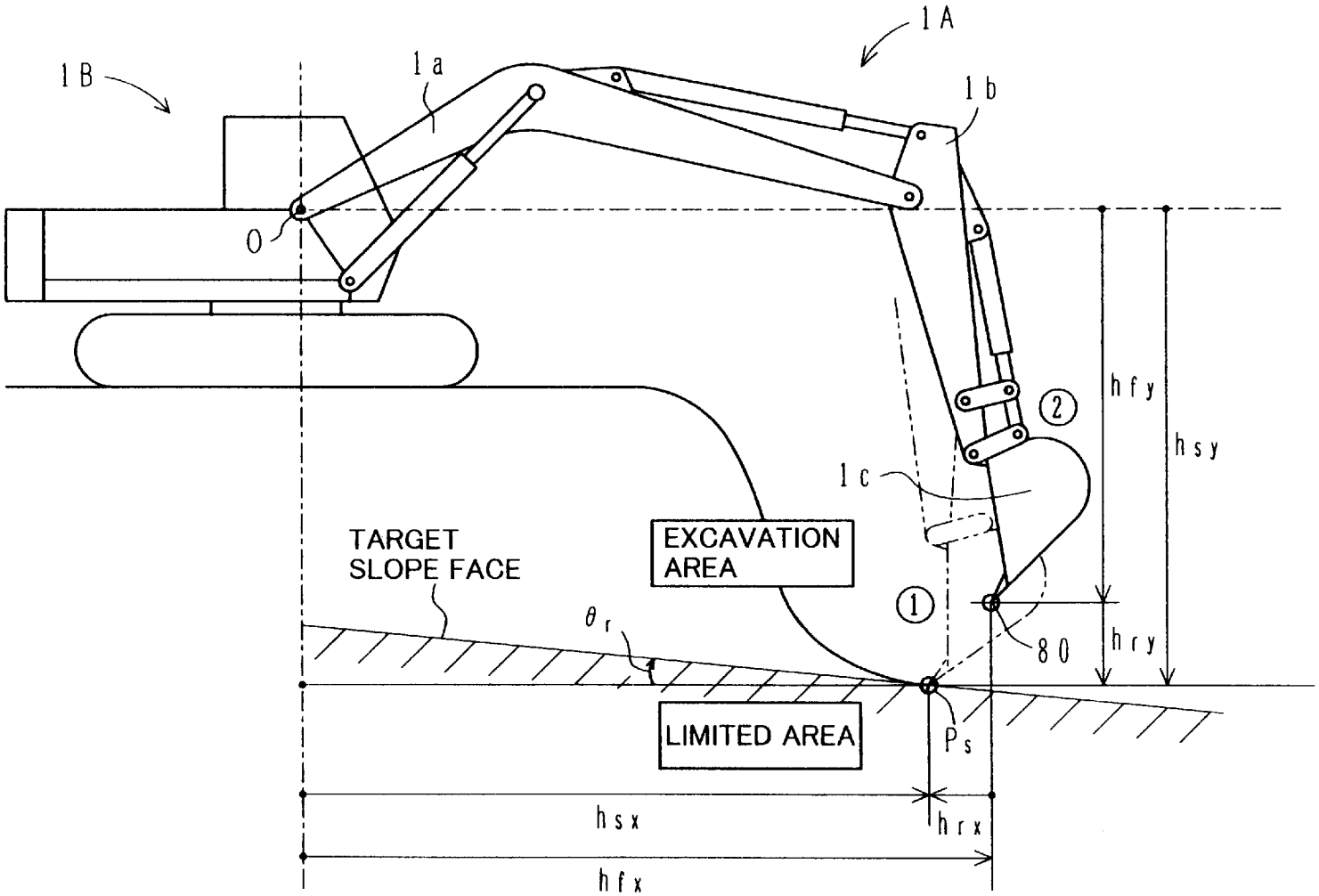
FIG. 15 is an explanatory view showing principles for setting a target slope face according to a second embodiment of the present invention.

A second embodiment of the present invention will be described with reference to FIGS. 15 and 16. This second embodiment intends to set the positional relationship between the external reference 80 and the target slope face by a direct teaching method, the setting being made by the first setting means 100 (see FIG. 9) in the above first embodiment. Note that an angle of the target slope face is input and set from the setting device 7.

More specifically, in the above first embodiment, the vertical distance hry and the horizontal distance hrx from the external reference 80 to the reference point Ps on the target slope face are set in the first setting means 100 by using the up and down buttons 7*a*, 7*b* (see FIG. 3) of the setting device 7. In this embodiment, the operator manipulates the control levers to move the end of the bucket 1*c* to a position to be set, as indicated by two-dot-chain lines in FIG. 15, and sets the vertical distance hry and the horizontal distance hrx by direct teaching of that position.

Figure 16:
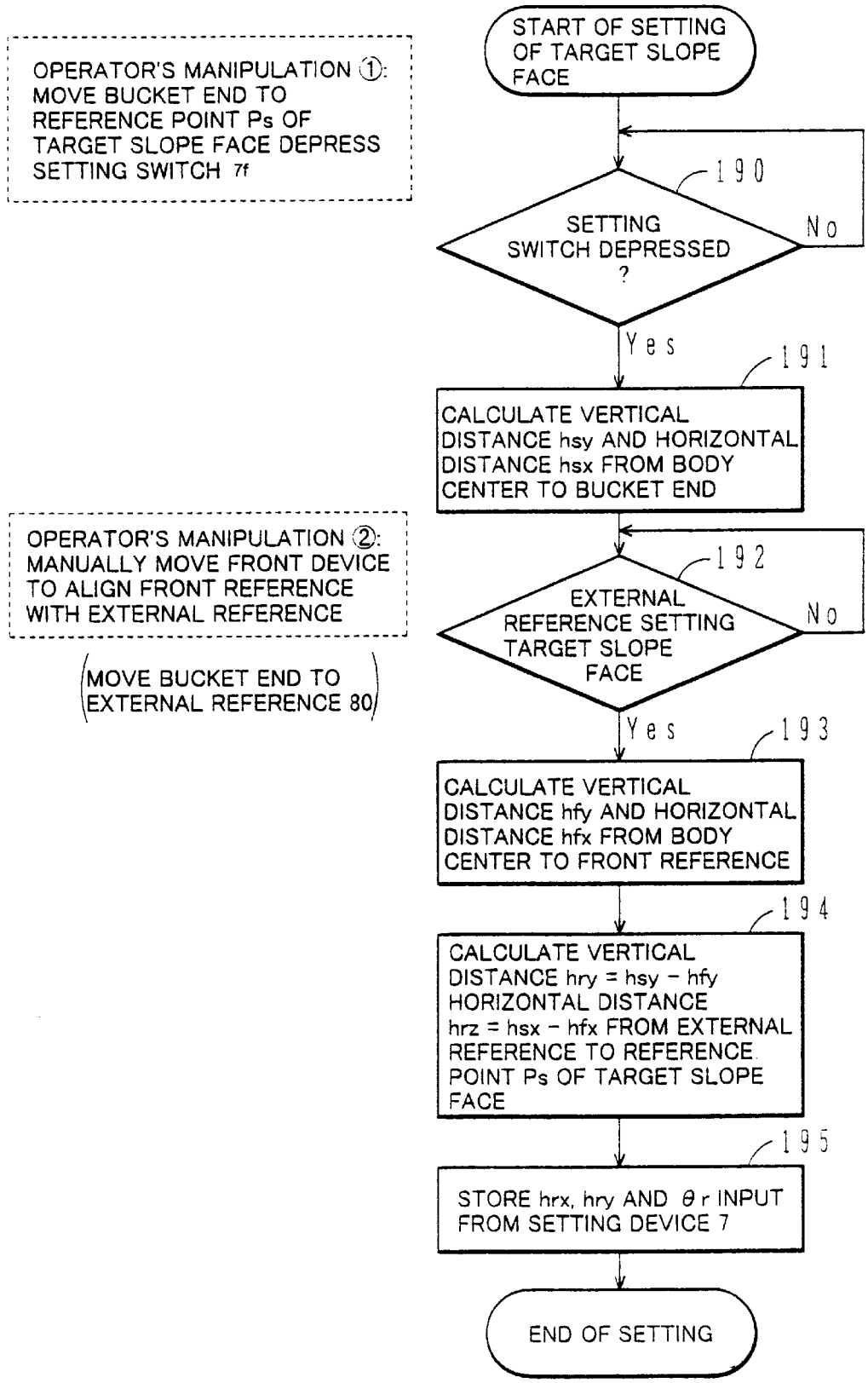
FIG. 16 is a flowchart showing a process flow of a first setting means in the second embodiment.

FIG. 16 shows a process flow of a method of setting the target slope face by direct teaching. In the drawing, blocks (1) and (2) circumscribed by broken lines represent manipulations that must be performed by the operator of the hydraulic excavator. First, as indicated in the block (1) of FIG. 16, the operator manipulates the control levers to move the front device 1A so that the end of the bucket 1*c* comes to the reference point Ps on the target slope face. When the end of the bucket 1*c* comes to the reference point Ps, the operator depresses the area setting switch 7*f* (see FIG. 3) of the setting device 7.

The control unit 9 (see FIG. 1) determines, in step 190, whether the area setting switch 7*f* is depressed or not. If not depressed, the control unit 9 repeats step 190. If the area setting switch 7*f* is depressed, the control unit 9 goes to step 191.

In step 191, the control unit calculates a vertical distance hsy and a horizontal distance hsx from the body center O to the end of the bucket 1*c* based on the posture of the front device 1A at that time.

Next, as indicated in the block (2) of FIG. 16, the operator manipulates the control levers again to move the front device 1A so that the front reference 70 (bucket prong) is aligned with the external reference 80.

During the above manipulation, the control unit repetitively determines in step 192 whether the external reference setting switch 71 is depressed or not. If the external reference setting switch 71 is depressed by the operator upon the front reference 70 being aligned with the external reference 80, the control unit goes to step 193.

In step 193, the control unit calculates a vertical distance hfy and a horizontal distance hfx from the body center O to the front reference 70 based on the posture of the front device 1A at that time.

Next, in step 194, a vertical distance hry and a horizontal distance hrx from the external reference 80 to the reference point on the target slope face are calculated from the following formulae:

$$hry=hsy-hfy \quad (12)$$

$$hrx=hsx-hfx \quad (12)$$

Finally, in step 195, the setting is ended by storing the vertical distance hry and the horizontal distance hrx thus determined, as well as an angle θr input from the setting device 7.

With this embodiment, since the target slope face is set by direct teaching, it is possible to precisely set a desired target slope face depending on work situations.

A third embodiment of the present invention will be described with reference to FIGS. 17 and 18.

In the above second embodiment, the vertical distance hry or the horizontal distance hrx for the reference point are set by the first setting means 100 shown in FIG. 9 upon the operator manipulating the control levers to move the end of the bucket 1*c* to the reference point on the target slope face for direct teaching of the position of the reference point, and the angle of the target slope face is set as an angle value input from the setting device 7. In this embodiment, as shown in FIG. 17, an angle θr of the target slope face is also set by direct teaching by directly teaching two points Ps1, Ps2 on the target slope face.

Figure 17:
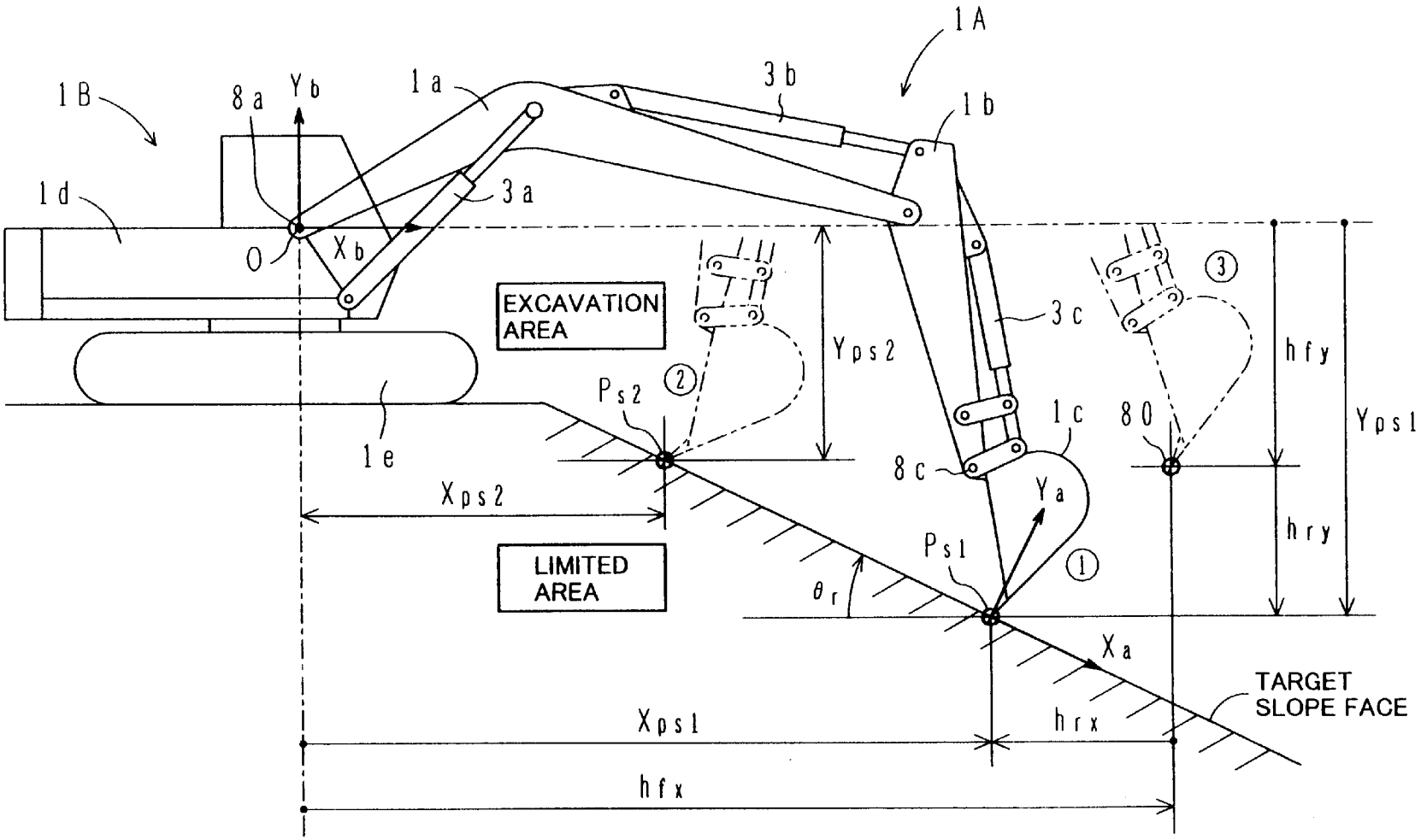
FIG. 17 is an explanatory view showing principles for setting a target slope face according to a third embodiment of the present invention.
Figure 18:
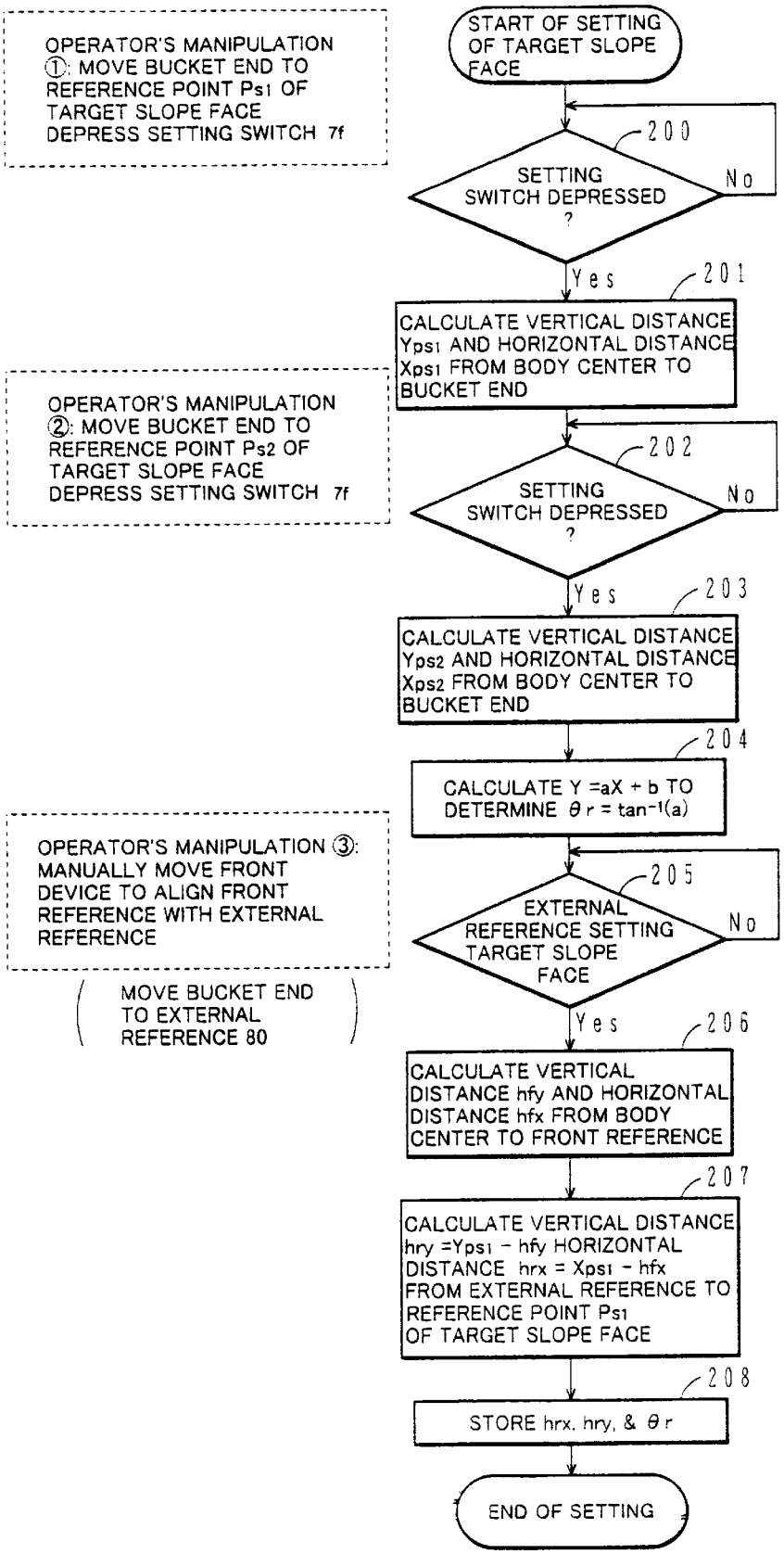
FIG. 18 is a flowchart showing a process flow of a first setting means in the third embodiment.

More specifically, after forming a first slope face by manual excavation, the bucket end is placed to each of the two points Ps1, Ps2 on the slope face as shown in FIG. 17, and the area setting switch 7*f* is depressed at each point. The control unit calculates and stores respective positions (coordinate values Xps1, Yps1) and (coordinate values Xps2, Yps2) of the two points through steps 200–203 shown in FIG. 18. After that, in step 203, a formula representing a boundary between the excavation area and the limited area on the XbYb-coordinate system is determined below from Ps1 (coordinate values Xps1, Yps1) and Ps2 (coordinate values Xps2, Yps2):

$$Y = aX + b$$

$$\text{where } a = (Yps1 - Yps2)/(Xps1 - Xps2)$$

$$b = (Yps1(Xps1 - Xps2) - Xps1(Yps1 - Yps2))/(Xps1 - Xps2)$$

Then, similarly to the above case of setting the horizontal distance, vertical distance and angle with the setting device 7, a target slope face is set by using the horizontal distance Xps1, the vertical distance Yps1 and the angle θr=tan−1(a). Specifically, steps 205–207 are executed for the external reference 80 as with the above case of setting the angle with the setting device 7, thereby calculating a horizontal distance hrx and a vertical distance hry from the external reference 80 to the point Ps1. The horizontal distance hrx, the vertical distance hry and the angle θr=tan−1(a) are stored in step 208, thus completing the setting.

INDUSTRIAL APPLICABILITY

The present invention provides the following advantages.

(1) Even when the positional relationship between the body and the finished slope is changed upon movement of the body in the lateral direction, a smooth slope extending continuously without steps can be formed.

(2) By adjusting the direction in which the external reference extends when installed, the slope to be formed can be freely set in direction in conformity with the topography.

(3) As compared with the method of detecting reference light by a sensor mounted on the body, control is less affected by errors such as manufacture tolerances of the body or tolerances in accuracy and mounting of the sensors, etc. Accordingly, excavation can be performed with a smaller difference from the set target slope face.

(3) Since the front reference can be formed of a small and simple member such as an arrow mark, the movement of the body can be compensated without needing a large-sized and complicated optical sensor.

(4) The movement of the body can be compensated over a wide range because of the fact that the front device, on which the front reference is provided, is movable over a wide range.

(5) Since the setting is made by the first setting means based on direct teaching, a desired target slope face can be precisely set depending on work situations.

What is claimed is:

1. A slope excavation control system for a hydraulic excavator comprising a plurality of vertically pivotable front members making up a multi-articulated front device, and a body for supporting said front device, said slope excavation control system including excavation plane setting means for setting a target excavation plane to be formed by excavation using said front device, said front device excavating the position of the target excavation plane under area limiting excavation control with which said front device is moved along the target excavation plane when said front device comes close to the target excavation plane, wherein said excavation plane setting means comprises:

(a) a front reference disposed on said front device and providing a reference for aligning said front device with an external reference provided to extend in the direction of advance of a target slope face;

(b) detecting means for detecting status variables in relation to a position and posture of said front device;

(c) first calculating means for calculating the position and posture of said front device on the basis of said body. from signals of said detecting means;

(d) first setting means for setting a positional relationship between said external reference and the target slope face;

(e) an external reference setting switch operated when said front reference is aligned with said external reference;

(f) second calculating means for calculating a positional relationship between said body and said external reference based on information about the position and posture of said front device calculated by said first calculating means when said external reference setting switch is operated, and calculating a positional relationship between said body and the target slope face from the positional relationship between said body and said external reference and the positional relationship between said external reference and the target slope face set by said first setting means; and (g) second setting means for setting the target slope face as a positional relationship on the basis of said body from the positional relationship between said body and the target slope face calculated by said second calculating means, and defining the set target slope face as said target excavation plane.

2. A slope excavation control system for a hydraulic excavator according to claim 1, wherein said first setting means is means for setting, as the positional relationship between said external reference and the target slope face, a vertical distance and a horizontal distance from said external reference to a reference point on the target slope face, and angle information of the target slope face.

3. A slope excavation control system for a hydraulic excavator according to claim 1, wherein said first setting means is means for setting the positional relationship between said external reference and the target slope face based on data input from a setting device.

4. A slope excavation control system for a hydraulic excavator according to claim 1, wherein said first setting means includes means for calculating, based on information about the position and posture of said front device calculated by said first calculating means, a position of an end of said front device taken when the end of said front device is aligned with a reference point on the target slope face, means for calculating, based on the information about the position and posture of said front device calculated by said first calculating means, a position of said front reference taken when said front reference is aligned with said external reference, means for calculating the positional relationship between said external reference and the reference point on the target slope face based on the position of the end of said front device and the position of said front reference, and means for storing the positional relationship calculated by said means and angle data input from a setting device.

5. A slope excavation control system for a hydraulic excavator according to claim 1, wherein said first setting means includes means for calculating, based on information about the position and posture of said front device calculated by said first calculating means, a position of an end of said front device taken when the end of said front device is aligned with a first reference point on the target slope face and a position of the end of said front device taken when the end of said front device is aligned with a second reference point on the target slope face, means for calculating angle information of the target slope face based on the positions of the end of said front device at said first and second reference points, means for calculating, based on the information about the position and posture of said front device calculated by said first calculating means, a position of said front reference taken when said front reference is aligned with said external reference, means for calculating a positional relationship between said external reference and one of the first and second reference points on the target slope face based on the position of the end of said front device and the position of said front reference, and means for storing the positional relationship calculated by said means and said angle information.

6. A target slope face setting system for a hydraulic excavator comprising a plurality of vertically pivotable front members making up a multi-articulated front device, and a body for supporting said front device, said front device excavating the position of a preset target excavation plane under area limiting excavation control with which said front device is moved along the target excavation plane when said front device comes close to the target excavation plane, wherein said target slope face setting means comprises:

(a) an external reference provided to extend in the direction of advance of a target slope face;

(b) a front reference disposed on said front device and providing a reference for aligning said front device with said external reference;

(c) detecting means for detecting status variables in relation to a position and posture of said front device;

(d) first calculating means for calculating the position and posture of said front device on the basis of said body (1B) from signals of said detecting means;

(e) first setting means for setting a positional relationship between said external reference and the target slope face;

(f) an external reference setting switch operated when said front reference is aligned with said external reference;

(g) second calculating means for calculating a positional relationship between said body and said external reference based on information about the position and posture of said front device calculated by said first calculating means when said external reference setting switch is operated, and calculating a positional relationship between said body and the target slope face from the positional relationship between said body and said external reference and the positional relationship between said external reference and the target slope face set by said first setting means; and (h) second setting means for setting the target slope face as a positional relationship on the basis of said body from the positional relationship between said body and the target slope face calculated by said second calculating means, and defining the set target slope face as said target excavation plane.

7. A target slope face setting system for a hydraulic excavator according to claim 6, wherein said external reference is a leveling string stretched to extend in the direction of advance of the target slope face.

8. A target slope face setting system for a hydraulic excavator according to claim 6, wherein said external reference comprises a plurality of poles provided in spaced relation in the direction of advance of the target slope face.

9. A target slope face setting system for a hydraulic excavator according to claim 6, wherein said external reference is a laser beam emitted in the direction of advance of the target slope face.

10. A slope excavation method using a hydraulic excavator comprising a plurality of vertically pivotable front members making up a multi-articulated front device, and a body for supporting said front device, said front device excavating the position of a preset target excavation plane under area limiting excavation control with which said front device is moved along the target excavation plane when said front device comes close to the target excavation plane, wherein said slope excavation method comprises the steps of:

(a) providing an external reference to extend in the direction of advance of a target slope face;

(b) setting a positional relationship between said external reference and the target slope face;

(c) aligning a front reference provided on said front device with said external reference, calculating a positional relationship between said body and said external reference, calculating a positional relationship between said body and the target slope face from the positional relationship between said body and said external reference and the positional relationship between said external reference and the target slope face set, setting the target slope face as a positional relationship on the basis of said body from the positional relationship between said body and the target slope face, and defining the set target slope face as said target excavation plane;

(d) forming a slope in a position of the target slope face by excavation carried out in a current body position of said hydraulic excavator under the area limiting excavation control;

(e) moving said body of said hydraulic excavator in the lateral direction relative to the slope formed by excavation in said step (d);

(f) carrying out the same steps as said steps (c) and (d) in a body position after movement in the lateral direction; and (g) carrying out said steps (e) and (f) repeatedly.

11. A slope excavation method according to claim 10, wherein said body of said hydraulic excavator comprises an upper revolving structure supporting said front device and a lower track structure mounting thereon said upper revolving structure in a revolvable manner, said step (d) of forming a slope by excavation is performed with said lower track structure held in a posture parallel to the direction of advance of the target slope face, and said step (e) of moving said body in the lateral direction is performed by traveling said lower track structure in the same posture as in said step (d).

12. A slope excavation method according to claim 10, wherein said body of said hydraulic excavator comprises an upper revolving structure supporting said front device and lower track structure mounting thereon said upper revolving structure in a revolvable manner, said step (d) of forming a slope by excavation is performed with said lower track structure held in a posture crossing the direction of advance of the target slope face, and said step (e) of moving said body in the lateral direction is performed by shifting said lower track structure in the transverse direction thereof by moving said lower track structure forward and backward repeatedly in the same posture as in said step (d).

13. A slope excavation method according to claim 10, wherein when the target slope face is curved in the direction of advance thereof in said step (a) of providing an external reference (80), said external reference (80) is also curved in the direction of advance of the curving target slope face.

* * * * *